US006851364B1

(12) United States Patent
Suda

(10) Patent No.: US 6,851,364 B1
(45) Date of Patent: Feb. 8, 2005

(54) PRINTING PLATE MATERIAL AND PRODUCTION AND REGENERATING METHODS THEREOF

(75) Inventor: Yasuharu Suda, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/646,876

(22) PCT Filed: Feb. 7, 2000

(86) PCT No.: PCT/JP00/00641

§ 371 (c)(1),
(2), (4) Date: Oct. 5, 2000

(87) PCT Pub. No.: WO00/46037

PCT Pub. Date: Aug. 10, 2000

(30) Foreign Application Priority Data

Feb. 5, 1999 (JP) ..... 11-029362
Mar. 30, 1999 (JP) ..... 11-090146

(51) Int. Cl.[7] ..... B41N 1/14; B41C 1/10

(52) U.S. Cl. ..... 101/456; 101/467; 101/478; 430/302

(58) Field of Search ..... 101/456, 463.1, 101/465–467, 478; 430/49, 56, 57, 84, 302

(56) References Cited

U.S. PATENT DOCUMENTS 3,717,464 A * 2/1973 Tandy ..... 101/465
4,718,340 A * 1/1988 Love, III ..... 101/467
5,713,287 A * 2/1998 Gelbart ..... 101/478
5,743,188 A * 4/1998 Ghosh et al. ..... 101/467
5,816,161 A * 10/1998 Nussel et al. ..... 101/478

(List continued on next page.)

FOREIGN PATENT DOCUMENTS

JP 9/131914 5/1997
JP 10-35131 2/1998

(List continued on next page.)

OTHER PUBLICATIONS

Miyauchi et al., "Recent developments of photocalytic reactions" (Nov. 26, 1999) (both English and Japanese versions).

(List continued on next page.)

*Primary Examiner*—Stephen R. Funk
(74) *Attorney, Agent, or Firm*—Oblon, Spivak, McClelland, Maier & Neustadt, P.C.

(57) ABSTRACT

A printing plate material which can be adapted to digitization of the printing process and recycled and a method for renewing it. As the printing plate material, there can be used one which includes a substrate on the surface of which a coat layer containing a titanium oxide photocatalyst and at least one member selected from salts or oxides of $Fe^{2+}$, $Ni^{2+}$, $Mn^{2+}$, $Cr^{3+}$, and $Cu^{2+}$ is formed. In an initial state of the printing plate as prepared, it is adjusted to a state where the surface of the coat layer is hydrophobic. This surface is irradiated with ultraviolet rays to convert a part of the surface to a hydrophilic surface. This conversion is performed based on digital data corresponding to an image to be printed. In this case, the hydrophobic portion is used as a printing image portion and the hydrophilic portion is used as a non-printing image portion. After completion of the printing, the compound is applied again to change the surface of the coat layer into the initial state of the printing plate as prepared, in which the surface of the coat layer exhibits hydrophobicity again.

41 Claims, 12 Drawing Sheets

U.S. PATENT DOCUMENTS

| | | | | | |
|---|---|---|---|---|---|
| 6,048,654 | A | * | 4/2000 | Nakayama et al. | 101/463.1 |
| 6,079,331 | A | * | 6/2000 | Koguchi et al. | 101/467 |
| 6,082,263 | A | * | 7/2000 | Koguchi et al. | 101/456 |
| 6,106,984 | A | * | 8/2000 | Kato et al. | 430/49 |
| 6,232,034 | B1 | * | 5/2001 | Kasai et al. | 430/302 |
| 6,237,493 | B1 | * | 5/2001 | Suda et al. | 101/465 |
| 6,258,512 | B1 | * | 7/2001 | Kasai et al. | 101/456 |
| 6,294,313 | B1 | * | 9/2001 | Kobayashi et al. | 101/453 |
| 6,318,264 | B1 | * | 11/2001 | D'Heureuse et al. | 101/467 |

FOREIGN PATENT DOCUMENTS

| | | | |
|---|---|---|---|
| JP | 10-250027 | | 9/1998 |
| JP | 11-078272 | | 3/1999 |
| JP | 11-123804 | | 5/1999 |
| JP | 11-123805 | | 5/1999 |
| JP | 11-123806 | | 5/1999 |
| JP | 11-123807 | | 5/1999 |
| JP | 11-147360 | | 6/1999 |
| JP | 11-174664 | | 7/1999 |
| JP | 11-208134 | | 8/1999 |
| JP | 11-245533 | | 9/1999 |
| JP | 11-249287 | | 9/1999 |
| JP | 11-258860 | | 9/1999 |
| JP | 11-344804 | | 12/1999 |
| JP | 2000-003046 | | 1/2000 |
| JP | 2000-062334 | * | 2/2000 |
| JP | 2000-062335 | * | 2/2000 |
| JP | 2000-181068 | | 6/2000 |
| WO | 99/08158 | * | 2/1999 |

OTHER PUBLICATIONS

Fujishima et al, "Titanium dioxide photocatalysis", Journal of Photochemistry and Photobiology C: Photochemistry Reviews 1 (2000) 1–21.

* cited by examiner (a): TITANIUM OXIDE SURFACE (HYDROPHILIC)

(b): ORGANIC TITANIUM COMPOUND (c): HYDROPHOBICIZATION OF TITANIUM OXIDE SURFACE BY FORMING ORGANIC HYDROPHOBIC GROUPS (d): BY-PRODUCT

PRINTING PLATE MATERIAL AND PRODUCTION AND REGENERATING METHODS THEREOF

TECHNICAL FIELD

The present invention relates to a printing plate material and to a method for preparation and renewal thereof.

BACKGROUND ART

In the field of printing technology in general, digitization of printing process has recently been in progress. This technology involves creation of images and documents or manuscripts in digitized form on a personal computer or reading images on a scanner to digitize the image data and directly making a printing plate based on the digital data thus obtained. This allows labor-saving in the whole printing process and facilitates high precision printing.

Hitherto, there has been generally used as a plate for use in printing a so-called PS plate which has anodized aluminum as a hydrophilic non-image part and a hydrophobic image part formed by curing a light-sensitive resin on a surface of the non-image part. To prepare a printing plate using the PS plate, a plurality of steps are necessary so that making of plates takes a long time and incurs high costs. Therefore, currently it is difficult to promote a reduction in time of printing process and a reduction in cost of printing. In particular, this is the major factor of an increase in printing costs in the case of making a small number of prints.

When printing of one picture pattern is completed, the plate has to be exchanged by a new one before next printing can be performed and the used plates have been disposed of. Further, with PS plates, it is impossible to directly make printing plates based on digital data and the making of printing plates is a hindrance to the progress of digitization of printing process in order to achieve labor-saving or high precision printing.

To obviate the above disadvantages with PS plates, several methods have been proposed to facilitate preparation of printing plates in accordance with the digitization of printing process, and some of them have been commercialized. For example, there are known methods which comprise providing a PET film having coated thereon a laser absorbing layer such as a carbon black layer and a silicone resin layer in order and imagewise irradiating the film with laser light to generate heat in the laser absorbing layer to burn off the silicone resin layer by the heat to prepare a printing plate, methods which comprise coating an oleophilic laser absorbing layer on an aluminum plate and a hydrophilic layer on the oleophilic laser absorbing layer and irradiating the hydrophilic layer with laser light to burn it off to make a printing plate, and the like. Although these methods allow preparation of printing plates directly based on digital data, in these methods, when the printing of one picture pattern is over, the printing plate must be exchanged by a new one before the next printing can be performed. Therefore, printing plates once used must be disposed of and in this regard, the above methods are the same as the method which uses the PS plate. That is, the cost of printing increases accordingly. From the viewpoint of protection of global environment which recently has come to be frequently advocated, the disposal of plates which have used once is undesirable.

In recent years, printing plate materials which comprise a photocatalyst and which can be renewed have been disclosed (Japanese Patent Applications, First Publications (Kokai), Nos. Hei 10-250027, Hei 11-245533, and Hei 11-249287, etc.). However, these publications do not explicitly describe the sensitivity of the photocatalysts to ultraviolet rays. In addition, these publications do not explicitly describe the time required for writing an image, or describe that it requires 1 hour to write an image (see Japanese Patent Application, First Publication (Kokai), No. Hei 11-249287), which is far from a practical level. Moreover, with regard to the renewal process, a heat treatment (130 to 200° C.×1 to 5 hours; see Japanese Patent Application, First Publication (Kokai), No. Hei 11-245533) and a process in which an additional photo-reactive layer is formed by lamination are disclosed. However, these renewal processes take too much time, or the renewal time is not explicitly described. Thus, at the present time, no renewal process has yet reached a practical level.

DISCLOSURE OF INVENTION

In order to solve the above problems, the present invention has taken the following countermeasures.

A first aspect of the present invention is a printing plate material which is characterized by comprising a substrate on the surface of which a coat layer containing a titanium oxide photocatalyst and a metal other than titanium is formed directly or with an intermediate layer intervening between the substrate and the coat layer.

Upon irradiation of a surface of the coat layer having hydrophobicity with light, those portions of the printing plate material of the invention irradiated become hydrophilic. This is attributable to the effect of the titanium oxide photocatalyst. In addition, by incorporating a metal other than titanium, the phenomenon of hydrophilization is promoted, and faster preparation of a printing plate is made possible. Utilization of the portions which have become hydrophilic as a non-printing image portion to which no ink will adhere and the remaining hydrophobic portion as a printing image portion to which ink will adhere allows the material to exhibit its function as a printing plate material. In the case where an intermediate layer is provided between the substrate and the coat layer, the adhesion strength of the coat layer can be maintained at a sufficient level.

BEST MODE FOR CARRYING OUT THE INVENTION

Figure 1:
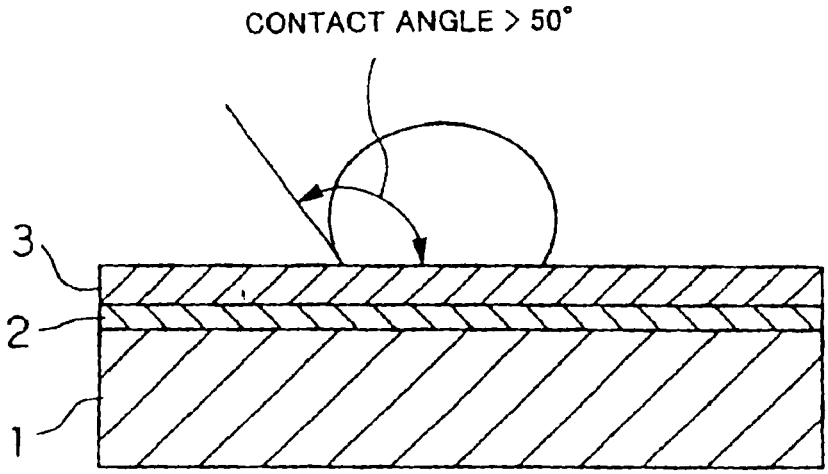
FIG. 1 is a cross-sectional view showing the construction of a printing plate material of the first embodiment. This figure also indicates the state in which the surface of the coat layer is hydrophobic.

Hereafter, aspects other than the above-described first aspect of the present invention will be described. A second aspect of the present invention is a printing plate material as in the first aspect, in which the metal other than titanium is at least one member selected from the group consisting of $Fe^{2+}$, $Ni^{2+}$, $Mn^{2+}$, $Cr^{3+}$, and $Cu^{2+}$.

With this printing plate material, by irradiation of a surface of the coat layer having hydrophobicity with light, the irradiated portion becomes hydrophilic. This is attributable to the effect of the titanium oxide photocatalyst. The phenomenon of hydrophilization is promoted by addition of at least one member selected from the group consisting of $Fe^{2+}$, $Ni^{2+}$, $Mn^{2+}$, $Cr^{3+}$, and $Cu^{2+}$, which enables more speedy plate making.

A third aspect of the present invention is a printing plate material as in the second aspect, in which the above-mentioned at least one member selected from the group consisting of $Fe^{2+}$, $Ni^{2+}$, $Mn^{2+}$, $Cr^{3+}$, and $Cu^{2+}$ is contained as an oxide.

A fourth aspect of the present invention is a printing plate material as in the third aspect, in which the oxide is a compound oxide with titanium.

In both the second and third aspects, irradiation of a surface of the coat layer with light promotes hydrophilization in the irradiated portion. This enables more speedy plate making. That is, regardless of which of an ionic state, an oxide state or a state of a compound oxide with titanium it is, the above-mentioned at least one of $Fe^{2+}$, $Ni^{2+}$, $Mn^{2+}$, $Cr^{3+}$, and $Cu^{2+}$, basically has an effect of promoting the phenomenon of hydrophilization of the oxide titanium photocatalyst by light irradiation to quickly convert the light-irradiated area of the surface of the plate to a hydrophilic non-printing image portion. Needless to say, as one of the forms of the ion, the above-mentioned at least one of $Fe^{2+}$, $Ni^{2+}$, $Mn^{2+}$, $Cr^{3+}$, and $Cu^{2+}$ may be contained in the coat layer in the form of salts.

A fifth aspect of the present invention is a printing material as in the first aspect, in which the metal other than titanium is a group VIB or IVA metal or an oxide thereof.

Upon irradiation of a surface in its initial state having hydrophobicity with light having an energy level higher than a band gap energy level of titanium oxide, those portions irradiated can be changed to become hydrophilic. This is attributable to the effect of the titanium oxide photocatalyst. Utilization of the portions which have become hydrophilic as a non-printing image portion to which no ink will adhere and the remaining hydrophobic portion as a printing image portion to which ink will adhere allows the material to exhibit its function as a printing plate.

In the step of forming a latent image on the surface of the plate material by irradiating it with light having an energy level higher than a band gap energy level of the titanium oxide (this step is hereinafter referred to as "image writing step"), the incorporation of a group VIB or IVA metal or a oxide thereof in the surface of the coat layer containing the titanium oxide photocatalyst or in the photocatalyst phase allows reduction of the energy required to convert the hydrophobic surface to the hydrophilic surface (this energy is hereinafter referred to as "plate material sensitivity").

A sixth aspect of the present invention is a printing plate material as in the fifth aspect, in which the group VIB metal is any of W, Mo, and Cr.

A seventh aspect of the present invention is a printing plate material as in the fifth aspect, in which the group IVA metal is any of Ge, Sn, and Pb.

A printing plate material according to either the sixth or seventh aspects allows reduction of the printing plate material sensitivity.

An eighth aspect of the present invention is a printing plate material as in any of the first to seventh aspects, in which the surface of said coat layer has hydrophobicity in terms of a water contact angle of at least 50° in its initial state.

With this construction, in its initial state as prepared, the printing plate is in a state where the entire surface of the printing plate can be a printing image portion.

A ninth aspect of the present invention is a printing plate material as in any of the first to seventh aspects, in which the surface of the coat layer is converted to a hydrophilic surface having a water contact angle of 10° or less by irradiation with light having a wavelength at an energy level higher than a band gap energy level of the titanium oxide photocatalyst.

With this construction, the surface of the coat layer irradiated with light having a wavelength at an energy level higher than that of the band gap energy of titanium oxide photocatalyst is converted to a hydrophilic surface, so that the converted portion can be utilized as a non-printing image portion. The irradiation with light may be performed based on, for example, digital data corresponding to the image to be printed. In this case, the printing plate material of the present invention can be said to be adapted to the digitization of the printing process. In the present invention, the step of writing an image by irradiation with light is referred to as preparation of a printing plate.

A tenth aspect of the present invention is a printing plate material as in any of the first to seventh aspects, in which the surface of the coat layer has hydrophobicity in terms of a water contact angle of at least 50° in its initial state and is converted to a hydrophilic surface having a water contact angle of 10° or less by irradiation with light having a wavelength at an energy level higher than a band gap energy level of the titanium oxide photocatalyst.

Therefore, with this construction, the effect which is a combination of the effect of the eighth aspect and the effect of the ninth aspect can be obtained.

An eleventh aspect of the present invention is a printing plate material as in the tenth aspect, in which the hydrophilic surface serves as a non-printing image portion and the remaining hydrophobic surface serves as a printing image portion. It can be said that this is a printing plate material having a similar effect to that of the printing plate material according to the seventh aspect. Therefore, the printing plate material can be said to be adaptable to the digitization of the printing process.

A twelfth aspect of the present invention is a printing plate material as in the tenth or eleventh aspect, which requires an energy of 0.005 to 2 J/cm$^2$ for converting the hydrophobicity of the surface of the coat layer to hydrophilicity, and on which an image can be directly formed based on digital data.

Upon irradiation of a surface in its initial state having hydrophobicity with light, those portions irradiated can be changed to become hydrophilic. This is attributable to the effect of the titanium oxide photocatalyst. Utilization of the portions which have become hydrophilic as a non-printing image portion to which no ink will adhere and the remaining hydrophobic portion as a printing image portion to which ink will adhere allows the material to exhibit its function as a printing plate. In the case where an image is directly written based on digital data, a proper plate material sensitivity is 0.005 to 2 J/cm$^2$ in order to manufacture a writing apparatus which is practical in view of cost, the size of the apparatus, and so on.

A thirteenth aspect of the present invention is a printing plate material as in any of the first to twelfth aspects, in which the surface of the coat layer, this surface being hydrophilic in at least a portion thereof, is reconverted to a hydrophobic surface having a water contact angle of at least 50° by irradiation with a flux of energy thereon.

With this construction, the surface of the coat layer which contains a portion which is hydrophobic becomes hydrophobic by irradiation with a flux of energy. Then, the printing plate material can be considered to have become one equivalent to the printing plate material of the eighth aspect, i.e., the printing plate material is in an initial state again. This means that the printing plate materials can be recycled.

A fourteenth aspect of the present invention is a printing plate material as in any of the first to twelfth aspects, in which the surface of the coat layer, this surface being hydrophilic in at least a portion thereof, is reconverted to a hydrophobic surface having a water contact angle of at least 50° by a chemical conversion treatment thereon.

This printing plate material when subjected to a chemical conversion treatment in place of the above-described flux of energy can give similar effects to those of the printing plate material of the thirteenth aspect.

A fifteenth aspect of the present invention is a printing plate material as in any of the first to twelfth aspects, in which the surface of the coat layer, this surface being hydrophilic in at least a portion thereof, is reconverted to a hydrophobic surface having a water contact angle of at least 50° by irradiation with a flux of energy thereon and by a chemical conversion treatment thereon.

This printing plate material when subjected to the above-described flux of energy and chemical conversion treatment in combination can give similar effects to those of the printing plate material of the thirteenth aspect. In this case, it has been shown that a plurality of means can be used to convert a hydrophilic surface to a hydrophobic surface, so that it is considered that the conversion can be completed quickly.

A sixteenth aspect of the present invention is a printing plate material as in the first aspect, in which the coat layer has a surface at least a part of which forms a part converted to a hydrophilic surface by irradiation with light having a wavelength at an energy level higher than a band gap energy of titanium oxide catalyst and a hydrophobic part which is not irradiated with the light, where the surface of the coat layer when subjected to light irradiation and an electrochemical treatment is hydrophobic.

With this printing plate material, upon irradiation of a surface of the coat layer having hydrophobicity with light, the irradiated portion becomes hydrophilic. This is attributable to the effect of the titanium oxide photocatalyst. Utilization of the portion which has become hydrophilic as a non-printing image portion to which no ink will adhere and the remaining hydrophobic portion as a printing image portion to which ink will adhere allows the material to exhibit its function as a printing plate material. The entire surface of the coat layer of the printing plate material can be converted to a hydrophobic surface by subjecting the surface of the coat layer in a state where at least a part thereof forms a part converted to a hydrophilic surface to light irradiation and an electrochemical treatment in combination. The effect of conversion from hydrophilicity to hydrophobicity by light irradiation and an electrochemical treatment is a new effect that the present inventors have discovered.

Provision of an intermediate layer between the substrate and the coat layer as needed makes it possible to maintain the adhesion strength of the coat layer at a sufficient level.

A seventeenth aspect of the present invention is a printing plate material as in the sixteenth aspect, in which the surface of the coat layer has hydrophobicity in terms of a water contact angle of at least 50° in its initial state.

With this construction, in its initial state as prepared, the printing plate is in a state where the entire surface of the printing plate can be a printing image portion.

An eighteenth aspect of the present invention is a printing plate material as in the sixteenth aspect, in which the surface of the coat layer is converted to a hydrophilic surface having a water contact angle of 10° or less by irradiation with light having a wavelength at an energy level higher than a band gap energy level of the titanium oxide photocatalyst.

With this construction, the surface of the coat layer irradiated with light having a wavelength at an energy level higher than that of the band gap energy of titanium oxide photocatalyst is converted to a hydrophilic surface, so that the converted portion can be utilized as a non-printing image portion. The irradiation with light may be performed based on, for example, digital data corresponding to the image to be printed. In this case, the printing plate material of the present invention can be said to be adapted to the digitization of the printing process.

A nineteenth aspect of the present invention is a printing plate material as in the sixteenth aspect, in which the surface of the coat layer has hydrophobicity in terms of a water contact angle of at least 50° in its initial state and is converted to a hydrophilic surface having a water contact angle of 10° or less by irradiation with light having a wavelength at an energy level higher than a band gap energy level of the titanium oxide photocatalyst.

With this construction, a printing plate can be prepared by writing a non-printing image portion on the hydrophobic surface of the coat layer having the function of a printing image portion with the above-described light, so that it can be said to be adaptable to the digitization of the printing process.

A twentieth aspect of the present invention is a printing plate material as in the nineteenth aspect, in which the hydrophilic surface serves as a non-printing image portion and the remaining hydrophobic surface serves as a printing image portion. It can be said that this is a printing plate material having a similar effect to that of the printing plate material according to the nineteenth aspect. Therefore, the printing plate material can be said to be adaptable to the digitization of the printing process.

A twenty-first aspect of the present invention is a printing plate material as in any of the sixteenth to twentieth aspects, in which the surface of the coat layer, this surface being hydrophilic in at least a portion thereof, is reconverted to a hydrophobic surface having a water contact angle of at least 50° by light irradiation thereon and an electrochemical treatment thereon.

With this construction, the surface of the coat layer which contains a portion which is hydrophobic is made hydrophobic by light irradiation thereon and an electrochemical treatment thereon in combination. Then, the printing plate material can be considered to have become one equivalent to the printing plate material of the seventeenth aspect, i.e., the printing plate material is in an initial state again. This means that the printing plate materials can be recycled.

A twenty-second aspect of the present invention is a printing plate material as in any of the first to twenty-first aspects, in which the surface of the coat layer, this surface being hydrophilic in at least a portion thereof, is reconverted to a hydrophobic surface having a water contact angle of at least 50° by cleaning the surface and renewing the surface of the coat layer containing the titanium oxide catalyst to renew the catalyst.

This can be achieved, for example, by forming a new coat layer again on the surface having hydrophilicity. With this construction, the entire surface of the printing plate material has hydrophobicity. That is, there emerges an initial state where all the surface constitutes a non-printing image portion. Therefore, this can give an effect similar to that derived according to the eighth to tenth aspects. In short, the printing plate material can be recycled. In the present invention, the step of uniformly rendering hydrophobic the entire surface of a coat layer containing the titanium oxide photocatalyst, this surface being hydrophilic in at least a portion thereof and hydrophobic in the remainder, is referred to as renewal of a printing plate material.

A twenty-third aspect of the present invention is a printing plate material as in the twenty-second aspect, in which the cleaning is polishing cleaning.

With this, the above cleaning step can be performed reliably and efficiently.

A twenty-fourth aspect of the present invention is a printing plate material as in the first aspect, which further comprises on the coat layer a coating layer comprising a compound which can be decomposed by irradiation with light having a wavelength at an energy level higher than a band gap energy level of the titanium oxide photocatalyst.

The surface of the printing plate material can be partitioned into a portion having hydrophobicity and a portion having hydrophilicity by the compound and the effect of the titanium oxide photocatalyst. The hydrophilic portion emerges by irradiating the surface of the coat layer with light (generally ultraviolet rays). Utilization of the hydrophilic converted portion as a non-printing image portion to which no ink will adhere and the remaining hydrophobic portion as a printing image portion to which ink will adhere allows the material to exhibit its function as a printing plate material. In the case where an intermediate layer is provided between the substrate and the coat layer, the adhesion strength of the coat layer can be maintained at a sufficient level.

A twenty-fifth aspect of the present invention is a printing plate material as in the twenty-fourth aspect, in which the metal other than titanium is at least one member selected from the group consisting of $Fe^{2+}$, $Ni^{2+}$, $Mn^{2+}$, $Cr^{3+}$, and $Cu^{2+}$.

This printing plate material has, in addition to the effect of the printing plate material of the twenty-fourth aspect, an effect of promoting the phenomenon of hydrophilization by containing at least one of $Fe^{2+}$, $Ni^{2+}$, $Mn^{2+}$, $Cr^{3+}$, and $Cu^{2+}$ in the coat layer, which enables more speedy plate making.

A twenty-sixth aspect of the present invention is a printing plate material as in the twenty-fifth aspect, in which the above-mentioned at least one member selected from the group consisting of $Fe^{2+}$, $Ni^{2+}$, $Mn^{2+}$, $Cr^{3+}$, and $Cu^{2+}$ is contained as an oxide.

A twenty-seventh aspect of the present invention is a printing plate material as in the twenty-sixth aspect, in which the oxide is a compound oxide with titanium.

In both the twenty-sixth and twenty-seventh aspects, irradiation of a surface of the coat layer with light promotes hydrophilization in the irradiated portion. This enables more speedy plate making. That is, regardless of which of an ionic state, an oxide state or a state of a compound oxide with titanium it is, the above-mentioned at least one of $Fe^{2+}$, $Ni^{2+}$, $Mn^{2+}$, $Cr^{3+}$, and $Cu^{2+}$, basically has an effect of promoting the phenomenon of hydrophilization of the oxide titanium photocatalyst by light irradiation to quickly convert the light-irradiated area on a surface of the plate to a hydrophilic non-printing image portion. Needless to say, as one of the forms of the ion, the above-mentioned at least one of $Fe^{2+}$, $Ni^{2+}$, $Mn^{2+}$, $Cr^{3+}$, and $Cu^{2+}$ may be contained in the coat layer in the form of a salt.

A twenty-eighth aspect of the present invention is a printing plate material as in the twenty-fourth aspect, in which metal other than titanium is a group VIB or IVA metal or an oxide thereof.

A twenty-ninth aspect of the present invention is a printing plate mater s in the twenty-eighth aspect, in which the group VIB a metal is any of W, Mo, and Cr.

A thirtieth aspect of the present invention is a printing plate metal as in the twenty-eighth aspect, in which the group VIA metal is any of Ge, Sn and Pb.

A printing plate material according to the twenty-eighth to thirtieth aspects of the present invention gives a similar effect to that of the printing plate material according to the above fifth to seventh aspects.

A thirty-first aspect of the present invention is a printing plate material as in any of the twenty-fourth to thirtieth aspects, in which the surface of the coat layer has hydrophobicity in terms of a water contact angle of at least 50° in its initial state.

With this construction, in its initial state as prepared, it can be said that the printing plate is in a state where the entire surface of the printing plate can be a printing image portion.

A thirty-second aspect of the present invention is a printing plate material as in any of the twenty-fourth to thirtieth aspects, in which the surface of the coat layer is exposed and is converted to a hydrophilic surface having a water contact angle of 10° or less by irradiation with the light.

With this construction, the surface of the coat layer irradiated with light having a wavelength at an energy level higher than that of the band gap energy of titanium oxide photocatalyst is converted to a hydrophilic surface, so that the converted portion can be utilized as a non-printing image portion. It is suggested that in the hydrophilization treatment, the following effects can be obtained. That is, there can be obtained the effect of its inherent "catalytic" effect attributable to the titanium oxide photocatalyst to promote the decomposition of the above-described compound and the effect of converting the surface of the titanium oxide photocatalyst itself to a hydrophilic surface having a water contact angle of 10° or less. Therefore, in this case, it is presumed that the above-described hydrophilization treatment can be completed quickly. The irradiation with light may be performed based on, for example, digital data corresponding to the image to be printed. In this case, it can be said that the printing plate material of the present invention is adapted to the digitization of the printing process.

A thirty-third aspect of the present invention is a printing plate material as in any of the twenty-fourth to thirtieth aspects, in which the surface of the coat layer has hydrophobicity in terms of a water contact angle of at least 50° in its initial state and is converted to a hydrophilic surface having a water contact angle of 10° or less by irradiation with the light.

Therefore, with this construction, the effect which is a combination of the effect of the thirty-first aspect and the effect of the thirty-second aspect can be obtained.

A thirty-fourth aspect of the present invention is a printing plate material as in the thirty-third aspect, in which the hydrophilic surface serves as a non-printing image portion and the remaining hydrophobic surface serves as a printing image portion.

It can be said that this is a printing plate material having a similar effect to that of the printing plate materials according to the thirty-first to thirty-third aspects. Therefore, the printing plate material can make the best of the inherent "catalytic" effect of the titanium oxide photocatalyst and it can be said that the printing plate material is adaptable to the digitization of the printing process.

A thirty-fifth aspect of the present invention is a printing plate material as in any of the first to twelfth aspects, in which the surface of the coat layer, this surface being hydrophilic in at least a portion thereof, is reconverted to a hydrophobic surface having a water contact angle of at least 50° by a reaction or strong interaction with a compound having an organic hydrophobic group in its molecule. Accordingly, the surface of the coat layer which contains a portion which is hydrophilic becomes hydrophobic. Then, the printing plate material can be considered to have been returned to its initial state. This means that the printing plate materials can be recycled.

A thirty-sixth aspect of the present invention is a printing plate material as in the thirty-fifth aspect, in which the compound having an organic hydrophobic group in its molecule is decomposable by a titanium oxide photocatalytic action under irradiation with light having an energy higher than a band gap energy of the titanium oxide photocatalyst. Accordingly, the compound having an organic hydrophobic group in its molecule is decomposed and eliminated by the titanium oxide photocatalytic action under irradiation with light having an energy higher than a band gap energy of the titanium oxide photocatalyst and the surface of the coat layer containing the titanium oxide photocatalyst is exposed, which allows formation of a hydrophilic surface by writing image.

A thirty-seventh aspect of the present invention is a printing plate material as in the thirty-fifth or thirty-sixth aspect, in which the compound having an organic hydrophobic group in its molecule is a fatty acid dextrin. Use of the fatty acid dextrin allows sufficient hydrophobization of the hydrophilic portion on the surface of the plate material with a small amount of the compound. In addition, this printing plate material has sufficient water resistance against dampening water, and the function of the printing image portion can be maintained during printing.

The thirty-eighth aspect of the present invention is a printing plate material as in the thirty-fifth or thirty-sixth aspect, in which the compound having an organic hydrophobic group in its molecule is an organic titanium compound.

The thirty-ninth aspect of the present invention is a printing plate material as in the thirty-fifth or thirty-sixth aspect, in which the compound having an organic hydrophobic group in its molecule is an organic silane compound.

In the printing plate material of either a thirty-eighth or thirty-ninth aspect, since the compound having an organic hydrophobic group in its molecule is chemically reacted with the surface of the titanium oxide catalyst, this printing plate material has an extremely high durability in comparison with the case where a hydrophobic oil, fat, or the like is used.

A fortieth aspect of the present invention is a printing plate material as in any of the first to twelfth aspects, which can be repeatedly used by repeating the steps of:

preparing a printing plate in which a latent image, which comprises a hydrophobic portion which is not irradiated with light and a portion which is irradiated with light to be changed to a hydrophilic surface, is formed by irradiating the printing plate material with light having an energy higher than a band gap energy of the titanium oxide photocatalyst, and renewing the printing plate material by allowing at least the hydrophilic portion on the surface of the plate material to react or strongly interact with a compound having an organic hydrophobic group in its molecule after removing an ink from the surface of the printing plate material after completion of printing.

A forty-first aspect of the present invention is a printing plate material as in any of the first to fortieth aspects, on which an image can be written using a writing apparatus which comprises a light source for emitting light having an energy higher than a band gap energy of the titanium oxide photocatalyst, and which directly forms an image on the plate material based on digital data.

A forty-second aspect of the present invention is a method for renewing a printing plate material as in the printing plate material of the first or sixteenth aspect, the method comprising the steps of:

cleaning a surface of a coat layer containing a titanium oxide photocatalyst after completion of printing; and then renewing the coat layer containing a titanium oxide photocatalyst.

Forty-third aspect of the present invention is a method for renewing a printing plate material as in the printing plate material of the first aspect, the method comprising the steps of:

cleaning a surface of a coat layer containing a titanium oxide photocatalyst after completion of printing; and then renewing the coat layer containing a titanium oxide photocatalyst by irradiation with a flux of energy thereon.

A forty-fourth aspect of the present invention is a method for renewing a printing plate material as in the printing plate material of the first aspect, the method comprising the steps of:

cleaning a surface of a coat layer containing a titanium oxide photocatalyst after completion of printing; and then renewing the coat layer containing a titanium oxide photocatalyst by a chemical conversion treatment thereon.

A forty-fifth aspect of the present invention is a method for renewing a printing plate material as in the printing plate material of the first aspect, the method comprising the steps of:

cleaning a surface of a coat layer containing a titanium oxide photocatalyst after completion of printing; and then renewing the coat layer containing a titanium oxide photocatalyst by irradiation with a flux of energy thereon and a chemical conversion treatment thereon in combination.

A forty-sixth aspect of the present invention is a method for renewing a printing plate material as in the printing plate material of the sixteenth aspect, the method comprising the steps of:

cleaning a surface of a coat layer containing a titanium oxide photocatalyst after completion of printing; and then renewing the coat layer containing a titanium oxide photocatalyst by light irradiation thereon and an electrochemical treatment thereon.

It is obvious that the renewal methods of the forty-second to forty-sixth aspects can give effects similar to those derived from the printing plate material of the twenty-second aspect.

A forty-seventh aspect of the present invention is a method for renewing a printing plate material as in any of the forty-second to forty-sixth aspects, in which the step of cleaning the surface of the coat layer and the step of renewing the coat layer are performed in a printing machine.

In this method, a continuous printing operation can be performed without stopping the printing machine or intervening in an operation for exchanging printing plates.

A forty-eighth aspect of the present invention is a method for renewing a printing plate material as in the printing plate material of the twenty-fourth aspect, the method comprising at least the steps of:

cleaning an outermost surface of the printing plate material including a surface of the coat layer, this surface being hydrophilic in at least a portion thereof, after completion of printing; and then renewing the coating layer to cause a hydrophobic surface having a water contact angle of 50° or more to emerge.

In this method, the surface of the coat layer is made hydrophobic by coating with a compound. Then, the printing plate material can be considered to have been returned to its initial state. This means that the printing plate materials can be recycled. In addition, the above, i.e., the operation of conversion to hydrophobicity, is achieved substantially exclusively by the operation of coating the compound, so that the operation concerned can be completed quickly.

A forty-ninth aspect of the present invention is a method for renewing a printing plate material as in the forty-eighth aspect, in which the step of cleaning the outermost surface and the step of renewing the coating layer are performed in a printing machine.

In this method, in actual printing, continuous operation of a printing machine can be achieved without stopping the operation, although it is considered that the above-described operation of conversion to hydrophobicity is generally accompanied with such a stopping of the operation.

A fiftieth aspect of the present invention is a method for preparing and renewing a printing plate material, in which the step of preparing a printing plate by irradiation of a surface of a coat layer of a printing plate material as in the printing plate material of the first or sixteenth aspect with light having a wavelength having an energy higher than a band gap energy of the titanium oxide photocatalyst, the step of cleaning the surface of the coat layer, and the step of renewing the coat layer are performed in a printing machine.

A fifty-first aspect of the present invention is a method for preparing and renewing a printing plate material, in which the step of preparing a printing plate by irradiation of a surface of a coat layer of a printing plate material as in the printing plate material of the twenty-four the aspect with having a wavelength having an energy higher than a band gap energy of titanium oxide photocatalyst to cause the above described surface of the coat layer in the irradiated region to emerge, the step of cleaning the outermost surface including the surface of the coat layer which has emerged, and the step of renewing the coat layer are performed in a printing machine.

In the methods for preparing and renewing a printing plate material according to the fiftieth and fifty-first aspects, the operation of printing involving the preparation of a printing plate material, printing, cleaning the outermost surface of a printing plate, and renewal of the printing plate material can be performed continuously without stopping the printing machine or intervening in an operation for exchanging printing plates.

First Embodiment

Hereafter, embodiments of the present invention will be described with reference to the attached drawings. FIG. 1 is a cross-sectional view showing the printing plate material according to the present embodiment. In FIG. 1, a substrate 1 is composed of aluminum. To use aluminum as a printing plate material is a common mode but the present invention is not limited thereto.

On the surface of the substrate 1 is formed an intermediate layer 2. The material which can be used for the intermediate layer 2 includes, for example, silicon based compounds such as silica ($SiO_2$), silicone resins, and silicone rubbers. Of these, in particular, there are used the silicone resins such as silicone alkyd, silicone urethane, silicone epoxy, silicone acrylic, and silicone polyester. The intermediate layer 2 is formed in order to ensure attachment of and secure the adhesion of the substrate 1 and a coat layer 3 described hereinbelow. That is, firmly bonding the substrate 1 and the intermediate layer 2 and also the coat layer 3 and the intermediate layer 2 allows the bond strength of the substrate 1 to the coat layer 3 to be secured.

On the intermediate layer 2 is formed the coat layer 3, which contains a titanium oxide photocatalyst. The surface of the coat layer 3 is hydrophobic in an initial state of the printing plate as prepared, and a portion which is hydrophilic emerges by irradiating the portion with ultraviolet rays. This property is attributable to the property of the above titanium oxide photocatalyst. This will be explained in detail later on. In addition, in the coat layer 3, a metal other than titanium such as at least one of $Fe^{2+}$, $Ni^{2+}$, $Mn^{2+}$, $Cr^{3+}$, and $Cu^{2+}$ is incorporated as an ion, an oxide, or a compound oxide with titanium.

In addition, the coat layer 3 may contain one or more of the following substances in order to improve the property of conversion from hydrophilicity to hydrophobicity or to increase the strength of the coat layer 3 or the adhesion of it to the substrate 1. Examples of the substances include silica based compounds such as silica, silica sol, organosilane, and silicone, metal oxides or metal hydroxides containing a metal such as zirconium or aluminum, fluorine contained resins, etc. Taking into consideration high oxidizing power of the titanium oxide photocatalyst, the coat layer 3 is preferably composed of inorganic compound or compounds from the viewpoint of preventing the coat layer 3 from deterioration.

Titanium oxide photocatalysts per se includes the anatase types and the rutile types having different crystal structures, respectively. In the present embodiment, either of them can be utilized. To enable high precision printing by increasing the resolution of the image to be written on a printing plate, and to enable the formation of the coat layer 3 in a small thickness, the titanium oxide photocatalyst preferably has a particle diameter of 0.1 $\mu$m or less.

As for the titanium oxide photocatalyst, specific examples thereof which are commercially available and can be used in the present embodiment include ST-01, ST-21, their processed products ST-K01 and ST-K03, water dispersed type STS-01, STS-02 and STS-21 all produced by Ishihara Sangyo Kaisha, Ltd.; SSP-25, SSP-20, SSP-M, CSB, and CSB-M, and paint type LAC TI-01, produced by Sakai Chemical Industry Co., Ltd.; ATM-100, ATM-600, and ST-157 produced by TAYCA Corporation; etc. However, it is needless to say that the present invention can be practiced with titanium oxide photocatalysts other than the above.

It is preferred that the coat layer 3 have a thickness in the range of 0.01 to 10 $\mu$m. This is because too small a film thickness makes it difficult to utilize the above-described properties sufficiently whereas too large a film thickness tends to lead to cracking of the coat layer 3, thereby causing a decrease in durability. The cracking is observed remarkably when the film thickness exceeds 50 $\mu$m so that it is necessary to note that an upper limit of the film thickness is 50 $\mu$m, preferably 10 $\mu$m, if the above range is to be relaxed. In a general mode, practically the film thickness is on the order of 0.1 to 3 $\mu$m.

The method for forming the coat layer 3 includes:

a method of coating a titanium oxide photocatalyst sol containing at least one of the salts of $Fe^{2+}$, $Ni^{2+}$, $Mn^{2+}$, $Cr^{3+}$, and $Cu^{2+}$;

a method of coating a mixture of a titanium oxide photocatalyst sol and at least one of the oxides of $Fe^{2}$ , $Ni^{2+}$, $Mn^{2+}$, $Cr^{3+}$, and $Cu^{2+}$;

a method of coating a mixture of a titanium oxide photocatalyst sol and at least one of the alkoxides of $Fe^{2+}$, $Ni^{2+}$, $Mn^{2+}$, $Cr^{3+}$, and $Cu^{2+}$;

a method of coating a mixture of an organic titanate and at least one of the alkoxides of $Fe^{2+}$, $Ni^{2+}$, $Mn^{2+}$, $Cr^{3+}$, and $Cu^{2+}$;

a method of vapor deposition using a pellet comprising a mixture of at least one of the oxides of $Fe^{2+}$, $Ni^{2+}$, $Mn^{2+}$, $Cr^{3+}$, and $Cu^{2+}$ and a titanium oxide photocatalyst in a predetermined mixing ratio;

a method of ion injection of at least one of $Fe^{2+}$, $Ni^{2+}$, $Mn^{2+}$, $Cr^{3+}$, and $Cu^{2+}$ into a titanium oxide photocatalyst layer formed by a vapor deposition method; etc.

In this case, for example, when a coating method is adopted, the coating liquid used therein may contain solvents, crosslinking agents, surfactants, etc. The coating liquid may be either of a room temperature drying type or of a heat drying type. It is more preferable to adopt the latter since it is more advantageous for increasing the durability of printing plate to increase the strength of the coat layer 3 by heating.

Hereafter, the operation and effect of the printing plate material having the above construction will be described. First, in an initial state of the printing plate material as prepared, the surface of the coat layer 3 is adjusted to have hydrophobicity in terms of a water contact angle of at least 50° as shown in FIG. 1. In this connection, a more preferred state may be obtained by adjustment such that the above contact angle is 80° or more. In this state, as can be seen from FIG. 1, it is difficult to water to adhere to the surface of the coat layer 3, that is, the surface of the coat layer 3 is in a state where its water repellency is very high. Expressing it the other way around, it can be said that there emerges a state where a printing ink can readily adhere to the surface of the coat layer 3.

The expression "an initial state of the printing plate material as prepared" can be interpreted as meaning the time of initiation in an actual printing process. More specifically, it indicates a state where, for any given image, digtized data thereof are already provided and an image from the data is being written onto the printing plate material. However, the stage at which the digitized data are provided may be after the hydrophobization treatment in respect of the surface of the coat layer 3 as described later on and the statement just above should not be construed in a strict sense. That is, when the "initial state of the printing plate material as prepared" is defined as the "time of initiation in an actual printing process," such should be interpreted in a broad sense.

Figure 2:
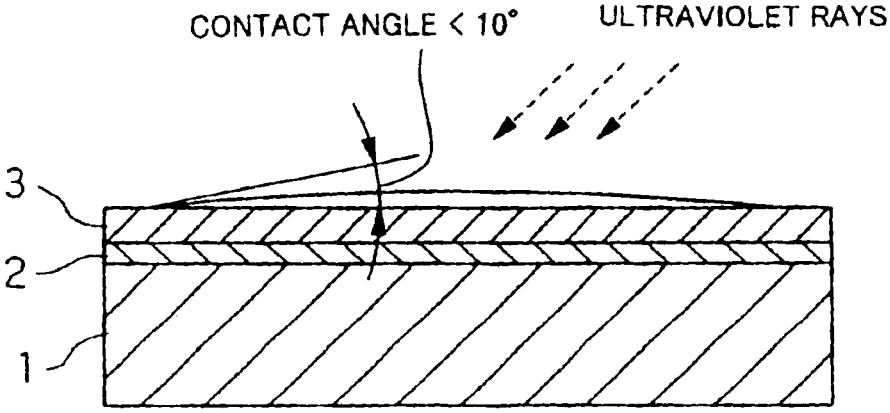
FIG. 2 is a cross-sectional view showing a printing plate material of which a surface of the coat layer is hydrophilic.

Next, the surface of the coat layer 3 in the above state is irradiated with ultraviolet rays as shown in FIG. 2. The irradiation with ultraviolet rays is performed in accordance with digital data on the above-described image and so as to correspond to the data. The ultraviolet rays as used herein refer to light having a wavelength having an energy higher than the band gap energy of the titanium oxide photocatalyst, more specifically, ultraviolet rays containing light having a wavelength of 400 nm or less.

Upon irradiation with the ultraviolet rays, the surface of the coat layer 3 becomes hydrophilic as shown in FIG. 2. This is attributable to the effect of the titanium oxide photocatalyst. As a result, the region irradiated with ultraviolet rays is in a state where its water contact angle is 10° or less. This state is just in a relationship opposite to the state of the hydrophobic surface earlier described. That is, water spreads on the surface of the coat layer 3 almost in the form of a film but it is impossible for printing inks to adhere to the surface.

The method for generating the hydrophilic portion based on the above image can be practiced without difficulty since it is only necessary to control the region which is irradiated with ultraviolet rays based on the above digital data of the image concerned. That is, unlike the conventional PS plates whose hydrophobic portion is formed by hardening a photosensitive resin, it can be said that the printing plate material of the present embodiment is adaptable to the digitization of printing process without difficulty.

Figure 3:
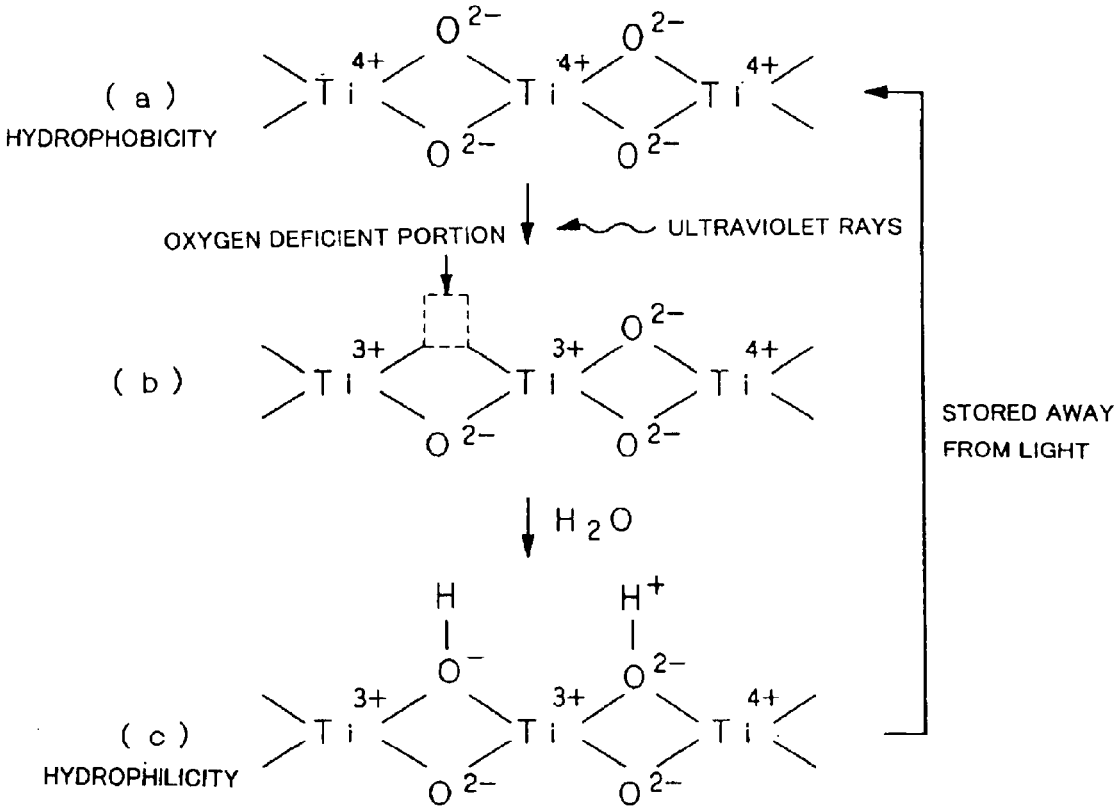
FIG. 3 is an illustrative diagram illustrating the conversion from hydrophobicity to hydrophilicity in a titanium oxide photocatalyst.

In this connection, the mechanism in which the titanium oxide photocatalyst is rendered hydrophilic by irradiation with ultraviolet rays is roughly presumed as follows. When the titanium oxide photocatalyst is hydrophobic, oxygen $O^{2-}$ is bonded in the form of a bridge between $Ti^{4+}$ ions on the surface thereof as shown in FIG. 3(*a*). Upon irradiation of this with ultraviolet rays, the bridge-like $O^{2-}$ is converted to an O atom, which is eliminated from the surface and the two electrons released from the eliminated $O^{2-}$ reduce two adjacent $Ti^{4+}$ to form $(Ti^{3+})$s as shown in FIG. 3(*b*). Then, water molecules in the air are adsorbed to the oxygen deficient portion to form hydroxyl groups. These hydroxyl groups further adsorb water molecules from the air and thereby a layer of hydroxyl groups is formed on the surface of the coat layer, resulting in hydrophilicity. Thus, the phenomenon of hydrophilization of the titanium oxide photocatalyst starts from the reduction process of $Ti^{4+}$ under irradiation with ultraviolet rays. Addition of at least one of $Fe^{2+}$, $Ni^{2+}$, $Mn^{2+}$, $Cr^{3+}$, and $Cu^{2+}$ into a titanium oxide photocatalyst layer in a small amount promotes the reduction process of $Ti^{4+}$. The addition amount is 0.05 to 5% by weight, and preferably 0.1 to 1% by weight. This is because if this amount is too small, the effect of promoting the reduction process of $Ti^{4+}$ is insufficient while if it is too large, the inherent function of the titanium oxide photocatalyst is damaged.

Figure 4:
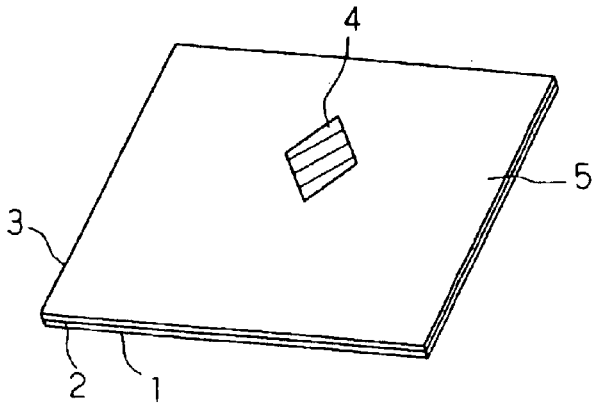
FIG. 4 is a perspective view showing an example of an image made on a surface of the coat layer (printing image portion) and its background (non-printing image portion).

When the treatment thus far is over, a hydrophobic printing ink is coated onto the surface of the coat layer 3. Then, or example, a printing plate material as shown in FIG. 4 is prepared. In FIG. 4, the hatched portion is a portion where the above hydrophilization treatment has not been performed, that is the hydrophobic portion, and hence indicates a printing image portion 4 where a printing ink is adhered. The remaining background portion 5, that is, the hydrophilic portion, repels the printing ink and hence indicates a non-printing image portion where no adhesion of the printing ink has occurred. Emergence of a picture pattern in this manner allows the surface of the coat layer 3 to function as a master plate.

Thereafter, a usual printing process is practiced and completed. Hereafter, two modes will be described.

Figure 5:
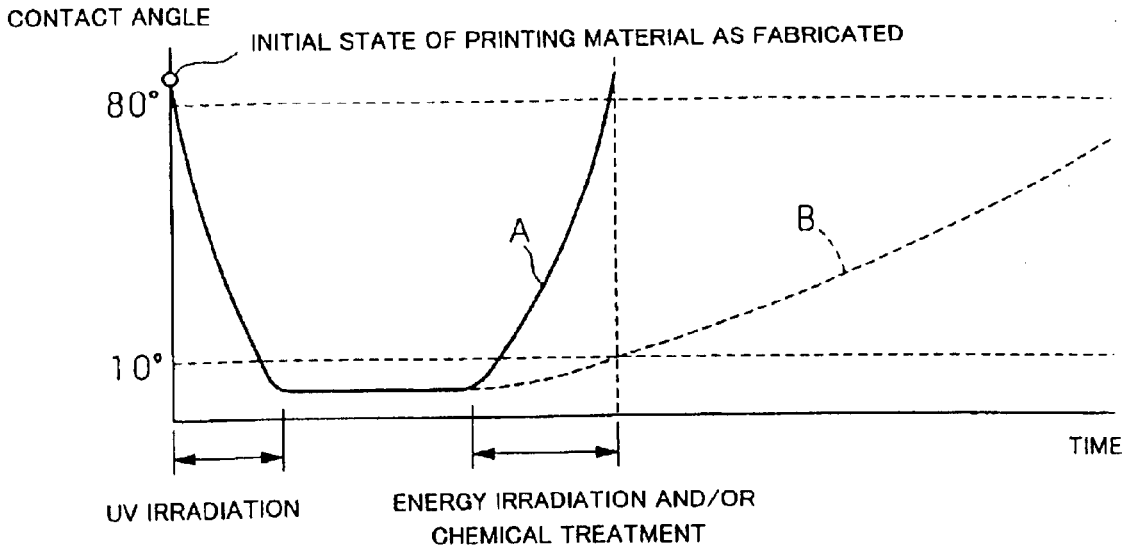
FIG. 5 is a graph illustrating the state of conversion from hydrophobicity to hydrophilicity of a surface of the coat layer with the passage of time.

As a first mode, a printing plate material which has passed through a usual printing process is provided and on the coat layer 3 thereof one of irradiation with a flux of energy of light, heat, sonic wave, electron beam, etc., is performed, and surface treatment with a chemical substance such as a solution of chemical, a gas, or a catalyst, that is, a chemical conversion treatment, is performed. These may be performed simultaneously or separately. Practicing such an operation (treatment for removing hydroxyl groups in the hydrophilic state as shown in FIG. 3) causes the hydrophilic portion of the coat layer 3 to become hydrophobic again as indicated by a curve A in FIG. 5. FIG. 5 is a graph plotting time in the horizontal axis vs. water contact angle in the the vertical axis, illustrating the change in water contact angle concerning a certain point on the surface of the coat layer 3 with the passage of time.

Usually, the hydrophilization treated titanium oxide photocatalyst has a property that its hydrophilized portion when stored in the dark naturally shifts to gradually become a surface having hydrophobicity (cf. curve B in FIG. 5). This shift is completed usually in a week to a month or so and, thereafter, the entire surface becomes hydrophobic again. Upon utilizing the hydrophobic performance and hydrophilic performance, generally efforts are made to maintain hydrophilicity. That is, it is a conventional way of thinking and general to make efforts to prolong the time required for the shift from hydrophilicity to hydrophobicity which takes a week to a month or so.

In the present embodiment, as described above, the addition of at least one of $Fe^{2+}$, $Ni^{2+}$, $Mn^{2+}$, $Cr^{3+}$, and $Cu^{2+}$ into the titanium oxide photocatalyst layer can increase the rate of hydrophilization when irradiated with ultraviolet rays, and a treatment is practiced which is intended to positively reverse the surface of the coat layer 3 having hydrophilicity to hydrophobicity by irradiation with a flux of energy and by a chemical conversion treatment. Therefore, no effort is made to maintain hydrophilicity nor is it necessary to wait for the completion of the shift, which takes a week to a month or so, but it is intended to try to have the shift from hydrophilicity to hydrophobicity occur in a very short period of time.

In the present embodiment, quick completion of the reversion to hydrophobicity enables returning to the above-described "initial state of the printing plate material as prepared" again. That is, the surface of the coat layer 3 has hydrophobicity such that the printing ink can be adhered to the entire surface of the coat layer. Irradiation of the surface with ultraviolet rays again enables preparation of a new master plate for printing. In short, the printing plate material of the present embodiment allows for its recycling, in other words repeated use.

Hereafter, another mode will be described. In this mode, first the surface of printing plate is wiped, that is, the ink, dampening water, etc., that are adhered to the surface of the coat layer 3 are wiped off. In other words, cleaning of the surface of the coat layer 3 is performed. Thereafter, the coat layer 3 containing the titanium oxide photocatalyst is formed again to create a new hydrophobic surface. The renewal of the coat layer 3 is practiced by using the above-described sol coating method, organic titanate method, vapor deposition method or the like appropriately. Practically, it is preferable to select the coating method. In this case, specifically, spray coating, blade coating, dip coating, roll coating, etc., methods may be used. The used coat layer may be removed before the coat layer 3 is renewed. Desirably, the renewed coated layer 3 has a film thickness of 0.05 $\mu$m or more. If the film thickness exceeds 20 $\mu$m, care must be taken since cracks tend to occur.

Figure 6:
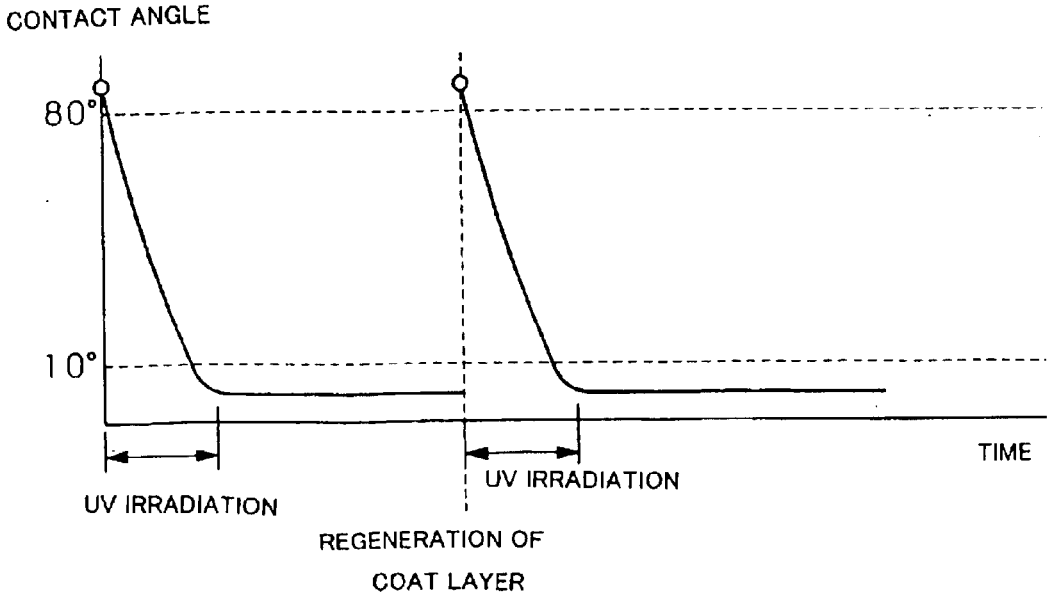
FIG. 6 is a graph illustrating the state of conversion from hydrophobicity to hydrophilicity of a surface of the coat layer with the passage of time in a mode different from that shown in FIG. 5.

From this it follows that in this mode too, as in the mode described with reference to FIG. 5, it is obvious that the printing plate can be used repeatedly or recycled as shown in FIG. 6. That is, since the coat layer 3 which provides a surface having hydrophobicity is created again, it can be said that the printing plate material at that point in time is reversed to the "initial state of the printing plate material as prepared." Hence, irradiation of this surface with ultraviolet rays enables preparation of a new master plate.

Hereafter, a more specific example relating to preparation and printing of a printing plate material which the present inventors have confirmed will be described. First, a substrate made of aluminum having a size of a post card and a thickness of 0.3 mm was provided. On this was coated a primer LAC PR-01 manufactured by Sakai Chemical Industry Co., Ltd. and dried. After the drying, the thickness of the primer layer was 1.4 $\mu$m. The primer layer corresponds to the intermediate layer 2 in FIG. 1. Thereafter, a titanium oxide photocatalyst coating agent LAC TI-01 manufactured by Sakai Chemical Industry Co., Ltd., containing NiO sol in an amount of 0.2% by weight as $Ni^{2+}$ based on titanium oxide was coated thereon and dried at 100° C. to form the coat layer 3 containing the titanium oxide photocatalyst having a thickness of 1.0 $\mu$m. Measurement of the printing plate material for a water contact angle on the surface of the coat layer 3 using a contact angle meter of CA-W type manufactured by Kyowa Kaimen Kagaku Co., Ltd. gave a water contact angle of 95°, thus exhibiting Next, the printing plate material was set on a card printing machine of SAN OFF-SET 220E DX type manufactured by SAN PRINTING MACHINES CO. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFELLOW manufactured by Mitsubishi Heavy Industries, Ltd. at a printing speed of 2500 sheets/hour. As a result, the ink adhered to the entire surface of the printing plate material (that is, the surface of the coat layer 3, hereafter the same), and a red image having the same size as the printing plate material and a uniform density could be printed on the paper.

With the printing plate material for which coating of the coat layer 3 was completed, i.e., the printing plate material in an initial state of the printing plate material as prepared, the surface of the coat layer 3 was irradiated with ultraviolet rays at an illuminance of 40 mW/cm$^2$ for 1 minute. Immediately thereafter, the water contact angle was measured using the above-described CA-W type contact angle meter, and a water contact angle of 4° was obtained, thus exhibiting hydrophilicity sufficient as a non-printing image portion. Using this printing plate material, printing was performed in the same manner as described above. As a result, no ink adhered to the printing plate and no image could be printed on the paper. In the case of the printing plate material prepared without addition of NiO sol, it took 5 minutes before a water contact angle of 10° or less could be reached as a result of irradiation with ultraviolet rays.

In the same manner as in the foregoing, in the printing plate material in an initial state of the printing plate material as prepared, a central part thereof was masked by black paper in the form of a square of 2 cm long in each side. The unmasked portion was irradiated with ultraviolet rays at an illuminance of 40 mW/cm$^2$ for 5 minutes and immediately thereafter, the water contact angle of the ultraviolet irradiated portion was measured using a CA-W type contact angle meter to obtain a water contact angle of 5°, thus exhibiting hydrophilicity sufficient as a non-printing image portion. Using this printing plate material, printing was performed in the same manner as described above. As a result, no ink adhered to the portion of the printing plate which was irradiated with ultraviolet rays and no image could be printed on the paper and a red image of a square of 2 cm long in each side corresponding to the portion of the printing plate material masked could be printed on the paper.

Next, two examples relating to the renewal of a printing plate material will be described below. First, a printing plate material from which the ink and dampening water adhered to the surface thereof were wiped off was placed in a dark room so that it could not be exposed even to weak ultraviolet rays. The dark room was kept in a nitrogen atmosphere. The surface of the printing plate material was subjected to a heat treatment at 180° C. for 5 minutes. As a result, the water contact angle of the surface of the printing plate material on which these treatments were completed was measured using CA-W type contact angle meter, and a water contact angle of 93° was obtained, which indicated that the surface was returned to a hydrophobic surface as before irradiation with ultraviolet rays.

Next, in a state where the printing plate was set on a card printing machine, the ink and dampening water adhered to the surface of the printing plate were wiped off and the above-described titanium oxide photocatalyst coating agent LAC TI-01 was coated onto the surface of the printing plate by roll coating. Thereafter, it was dried in hot air at 120° C. to renew the coat layer 3 containing the titanium oxide photocatalyst. Using this renewed plate, printing was performed in the same manner as in the printing before the renewal. As a result, the ink adhered to the entire surface of the printing plate material and a red image having the same size as the printing plate and a uniform density could be printed on the paper.

Figure 11:
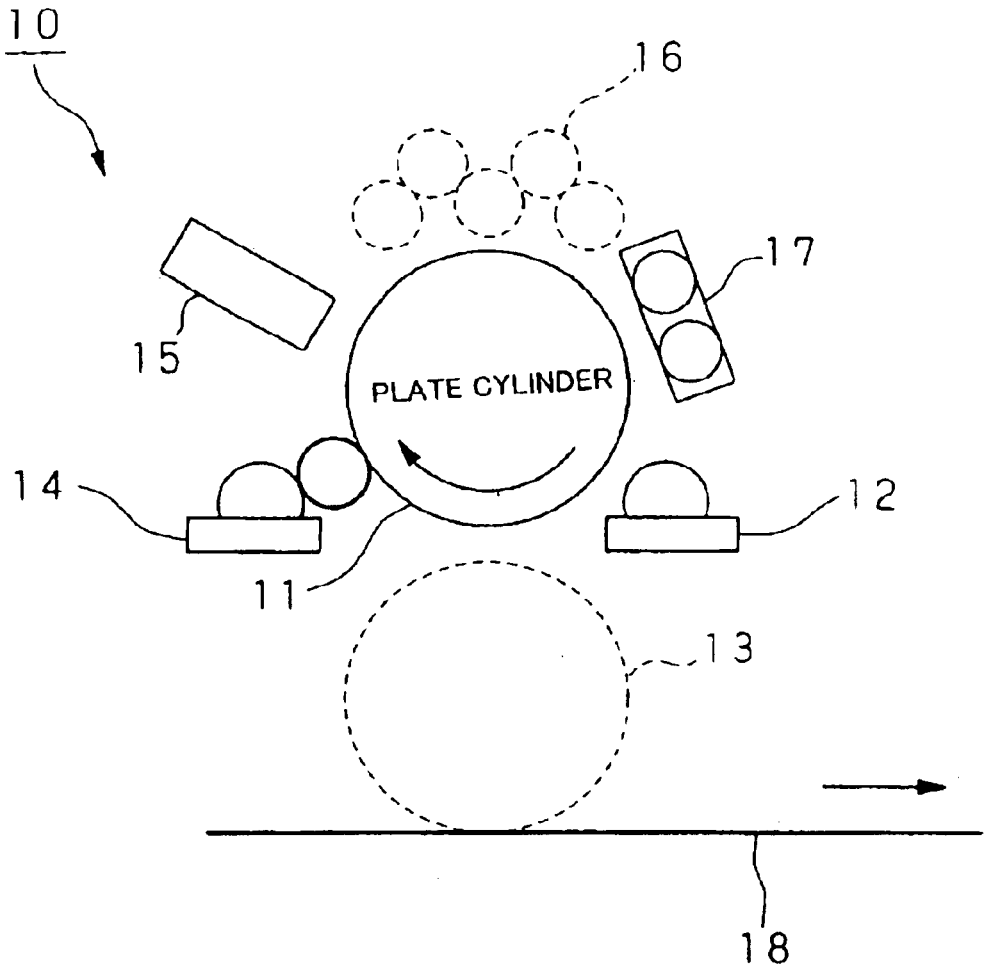
FIG. 11 is an illustrative diagram illustrating an example of the construction of a printing machine.

The above printing was performed using a printing machine 10 as shown in FIG. 11. Specifically, the printing machine 10 comprises a coating apparatus 12 (renewal apparatus), a blanket cylinder 13, a plate cleaning apparatus 14 (cleaning apparatus), a writing apparatus 15, an inking roller 16, and a drying apparatus 17 around the plate cylinder 11 in the center. The printing plate material is arranged wound around the plate cylinder 11.

The process for renewing the printing plate after completion of the printing as described above was performed as follows. First the plate cleaning apparatus 14 was brought into contact with the plate cylinder 11 and the ink and dampening water adhered to the surface of the printing plate were wired off. Thereafter, the plate cleaning apparatus 14 was released from the plate cylinder 11 and the coating apparatus 12 was brought into contact with the plate cylinder 11. By so doing, the coat layer 3 was being renewed on the printing plate material. Thereafter, the coating apparatus 12 was released from the plate cylinder 11, followed by operating the drying apparatus 17 to evaporate the solvents, etc., contained in the coat layer 3. Then, an image was written on the renewed surface of the coat layer 3 with ultraviolet rays emitted by the writing apparatus 15 based on digital data of the image provided in advance. After completion of the above steps, the inking roller 16 and the blanket cylinder 13 were brought into contact with the plate cylinder 11. Then paper 18 was fed so as to make contact with the blanket cylinder 13 and to be carried in the direction of the arrow as shown in FIG. 11 so that continuous printing could be performed.

As described above, the printing plate material of the present embodiment makes the best of the property of titanium oxide photocatalyst, i.e., its property of converting hydrophobicity to hydrophilicity, thereby enabling its recycling and considerably decreasing the amount of printing plate material to be disposed of after use. Therefore the cost incurred by printing plate materials can be decreased to a greater extent accordingly. In addition, it can increase the rate of hydrophilization under irradiation with ultraviolet rays by addition therein of at least one of $Fe^{2+}$, $Ni^{2+}$, $Mn^{2+}$, $Cr^{3+}$, and $Cu^{2+}$ in the form of ions, oxides, or composite oxides with titanium so that the time required for writing of images to the printing plate material can be reduced.

Since reconversion of printing plate materials and practice of renewal of the coat layer 3 can be performed in a printing machine, speeding up of the printing operation can be realized. In the above examples, writing of images to the surface of the coat layer 3 was performed in a printing machine and therefore operation can be practiced more speedily.

In the present embodiment, the intermediate layer 2 was provided between the substrate 1 and the coat layer 3. However, the present invention is not limited thereto. That is, the intermediate layer 2 does not have to be provided. This is because the major essential features of the present invention are not harmed by the absence of the intermediate layer 2 as will be apparent from the explanation thus far made.

In regard to the renewal of printing plates, the above explanation was made using embodiments or examples involving freshly coating the coat layer 3. On this point, the following supplemental explanation will be made. That is, similar effects can be obtained by such a method as to scrape off the superficial portion of the thus far used coat layer 3 but not newly coating the coat layer 3 after the completion of the printing. That is, scraping off the entire superficial portion of the coat layer 3 after completion of the printing as shown in FIG. 2, for example, results in removal of the hydrophilic portion by a single effort and instead a new surface of the coat layer 3 hidden therebelow can emerge. Since the new surface of the coat layer 3 exhibits hydrophobicity, it is understandable that such a method can also cause the initial state of the printing plate material as prepared to emerge. The "renewal of the coat layer" as used herein encompasses the idea as described just above in its scope.

Second Embodiment

Hereafter, a second embodiment of the present invention will be described.

Figure 7:
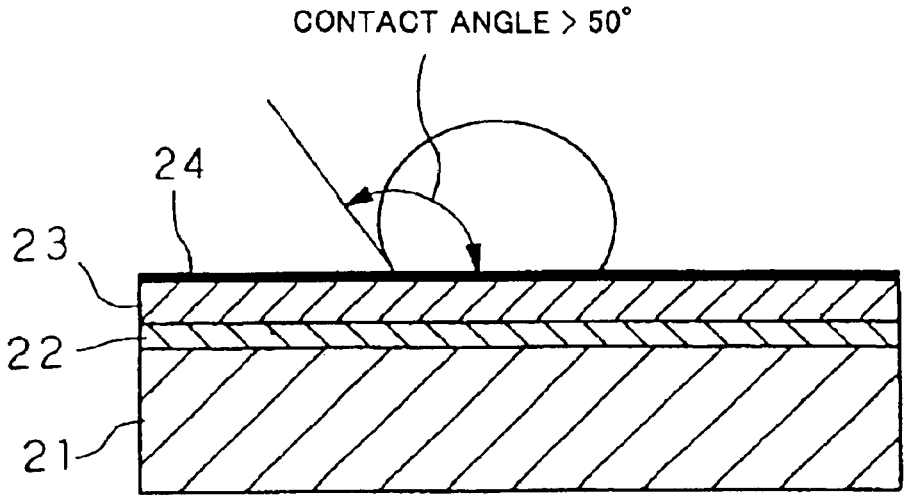
FIG. 7 is a cross-sectional view showing the construction of a printing plate material of the second embodiment. This figure also indicates the state where a surface of the coat layer is hydrophobic.

FIG. 7 is a cross-sectional view showing a printing plate material of this embodiment. In FIG. 7, the substrate 21, the intermediate layer 22, and the coat layer 23 are the same as those in the above first embodiment, and therefore detailed explanation thereof is omitted here.

On the coat layer 23 is formed a coating layer 24 composed of a compound which can be decomposed by irradiation thereof with light with a wavelength having an energy higher than a band gap energy of the titanium oxide photocatalyst. The surface of the coating layer 24 is adjusted to have hydrophobicity in terms of a water contact angle of at least 50° as shown in FIG. 7. In this connection, it is a more preferable state if the surface of the coating layer 24 is adjusted to a water contact angle of 80° or more. In this state, as will be understood from FIG. 7, it is difficult for water to adhere to the surface of the coating layer 24, that is, the coating layer 24 has high water repellency. Expressing it the other way around, it can be said that there emerges a state where a printing ink can readily adhere to the surface of the coating layer 24.

Hereafter, the operation and effect of the printing plate material having the above construction will be described. First, in an initial state of the printing plate material as prepared, the surface of the coat layer 23 is adjusted to have hydrophobicity in terms of a water contact angle of at least 50° as shown in FIG. 7. The expressions "an initial state of the printing plate material as prepared" and "adjustment so as to have hydrophobicity" indicate the following situations. First, "adjustment so as to have hydrophobicity" is carried out by forming the coating layer 24 composed of a compound which can be decomposed by irradiation of the surface of the coat layer 23 with ultraviolet rays and drying it. For this coating can be appropriately adopted a method selected from spray coating, blade coating, dip coating, roll coating, etc., methods. The drying may be performed at room temperature or with heating. When the surface of the coat layer 23 becomes hydrophobic by the "adjustment," it is defined to be "in an initial state of the printing plate material as prepared."

The above compound is preferably not only one having the effect of imparting hydrophobicity to the above-described surface but also one which can be "readily" subject to oxidative decomposition reaction by irradiation with ultraviolet rays. Specifically, there can be cited, for example:

(1) alkoxysilanes such as trimethylmethoxysilane, trimethylethoxysilane, dimethyldiethoxysilane, methyltrimethoxysilane, tetramethoxysilane, methyltriethoxysilane, tetraethoxysilane, methyldimethoxysilane, octadecyltrimethoxysilane, and octadecyltriethoxysilane;

(2) chlorosilanes such as trimethylchlorosilane, dimethyldichlorosilane, methyltrichlorosilane, methyldichlorosilane, and dimethylchlorosilane;

(3) silane coupling agents such as vinyltrichlorosilane, vinyltriethoxysilane, γ-chloropropyltrimethoxysilane, γ-chloropropylmethyldichlorosilane, γ-chloropropylmethyldimethoxysilane, γ-chloropropylmethyldiethoxysilane, and γ-aminopropyltriethoxysilane;

(4) silazanes such as hexamethyldisilazane, N,N'-bis (trimethylsilyl)urea, N-trimethylsilylacetamide, dimethyltrimethylsilylamine, and diethyltrimethylsilylamine;

(5) fluoroalkylsilane such as perfluoroalkyltrimethoxysilane;

(6) silicone oils of the type of dimethyl hydrogen polysiloxane;

(7) fatty acids such as lauric acid, myristic acid, palmitic acid, stearic acid, and oleic acid;

(8) titanium alkoxides such as titanium tetraisopropoxide, titanium tetra-n-butoxide, and titanium tetrastearoxide;

(9) titanium acylates such as tri-n-butoxytitanium stearate and isopropoxytitanium tristearate;

(10) titanium chelates such as diisopropoxytitanium bisacetylacetonate and dihydroxy bislactatotitanium; and

(11) fatty acid dextrins.

However, it is needless to say that the present invention is not limited to these compounds. In addition, these compounds may of course be diluted with a solvent when used if necessary.

The expression "an initial state of the printing plate material as prepared" in general can be interpreted as meaning the time of initiation in an actual printing process. That is, it indicates a state where, for any given image, digitized data thereof are already provided and an image from the data is being written onto the printing plate material. However, the stage at which the digitized data are provided may be after the hydrophilization treatment in respect of the surface of the coat layer 23 as described later on and the statement just above should not be construed in a strict sense. That is, when the "initial state of the printing plate material as prepared" is defined as the "time of initiation in an actual printing process," such should be interpreted in a broad sense.

Figure 8:
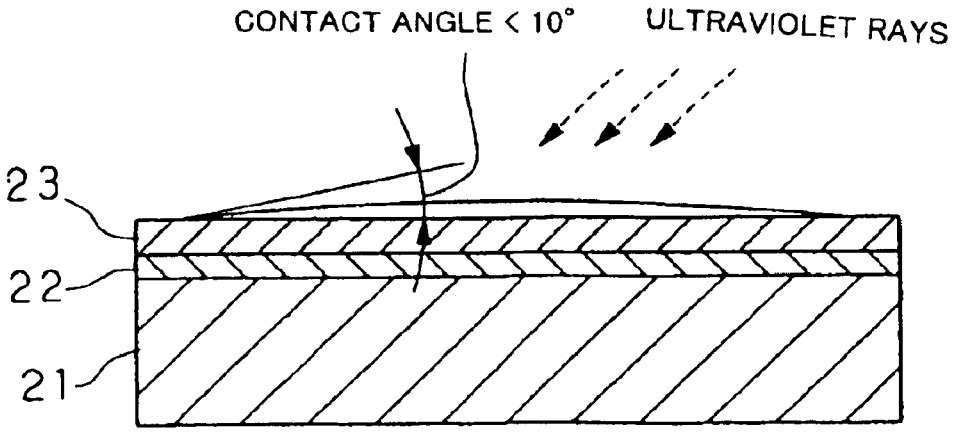
FIG. 8 is a cross-sectional view showing a printing plate material in which the surface of the coat layer is in a hydrophilic state.

Next, the surface of the coating layer 24 in the above state is irradiated with ultraviolet rays as shown in FIG. 8. The irradiation with ultraviolet rays is performed in accordance with digital data on the above-described image and so as to correspond to the data. The ultraviolet rays as used herein refer to light having a wavelength having an energy higher than the band gap energy of the titanium oxide photocatalyst, more specifically, ultraviolet rays containing light having a wavelength of 400 nm or less.

The irradiation with ultraviolet rays decomposes the compound constituting the coating layer 24 as also shown in 23 FIG. 8, causing the surface of the coat layer 23 to emerge and converting the surface to have hydrophilicity. This is attributable to the effect of the titanium oxide photocatalyst. Since the decomposition of the compound proceeds by the inherent catalytic effect of the titanium oxide photocatalyst, it is completed very quickly. This puts the region of the surface of the coat layer 23 irradiated with ultraviolet rays in a state of having a water contact angle of 10° or less. This stage is exactly opposite the state of the hydrophobic surface in the coating layer 24 described earlier. That is, water spreads on the surface of the coat layer 23 almost in almost in the form of a film whereas it is impossible for a printing ink to adhere on the surface thereof.

Description of the mechanism by which the titanium oxide photocatalyst is hydrophilized is omitted here since it is already described in the first embodiment, however, it should be added that in the present invention, the hydrophilization of the titanium oxide photocatalyst is promoted by addition of at least one of $Fe^{2+}$, $Ni^{2+}$, $Mn^{2+}$, $Cr^{3+}$, and $Cu^{2+}$ into the coat layer containing the titanium oxide photocatalyst in a small amount.

Figure 9:
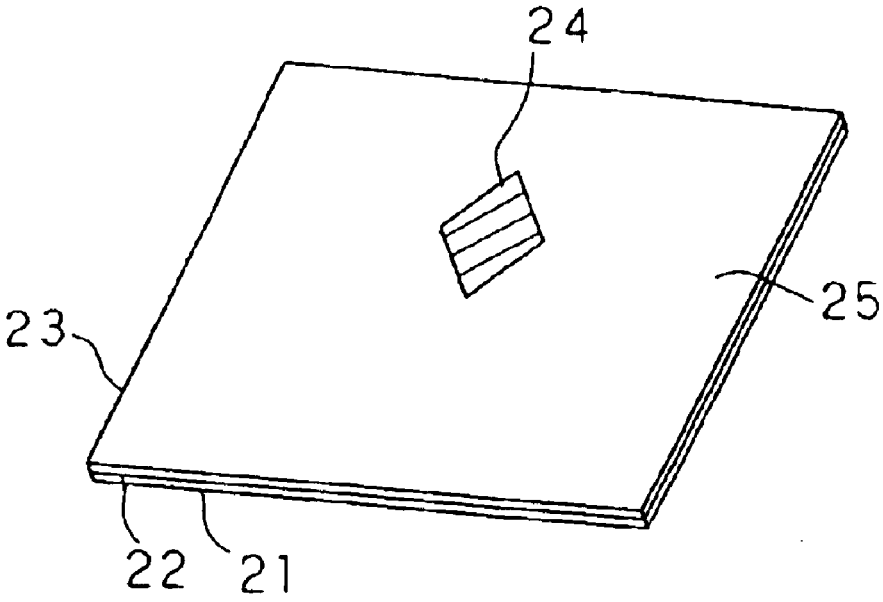
FIG. 9 is a perspective view showing an example of an image made on a surface of the coat layer (printing image portion) and its background (non-printing image portion).

When the treatment thus far is over, a hydrophobic printing ink is coated onto the surface of the coating layer 24 or the hydrophilization treated coat layer 23. Then, for example a printing plate material as shown in FIG. 9 is prepared. In FIG. 9, the hatched portion is a portion where the above hydrophilization treatment has not been performed, that is the hydrophobic portion or a portion where the coating layer 24 remains and hence indicates a printing image portion where printing ink is adhered. The remaining non-imaged portion, that is, the hydrophilic portion 25 or the portion where the surface of the coat layer 23 emerges, repels the printing ink and hence indicates a non-printing image portion where no adhesion of the printing ink has occurred. Emergence of a picture pattern in this manner allows the the printing plate material to function as a master plate.

Thereafter, usual printing process is practiced and completed. Hereafter, two examples will be described. On the printing plate material, after completion of the printing, a coating layer 24 composed of the above-described compound is formed again. Therefore, the printing plate material is reversed to the "initial state of the printing plate material as prepared" in a stage where the coating is completed. That is, on the surface of the coat layer 23 at this point in time, the coating layer 24 which allows adhesion of a printing ink onto its entire surface is formed and has hydrophobicity. Irradiation of the surface with ultraviolet rays again enables preparation of a new master plate for printing. In short, the printing plate material of the present embodiment allows for its recycling, in other words, repeated use.

Figure 10:
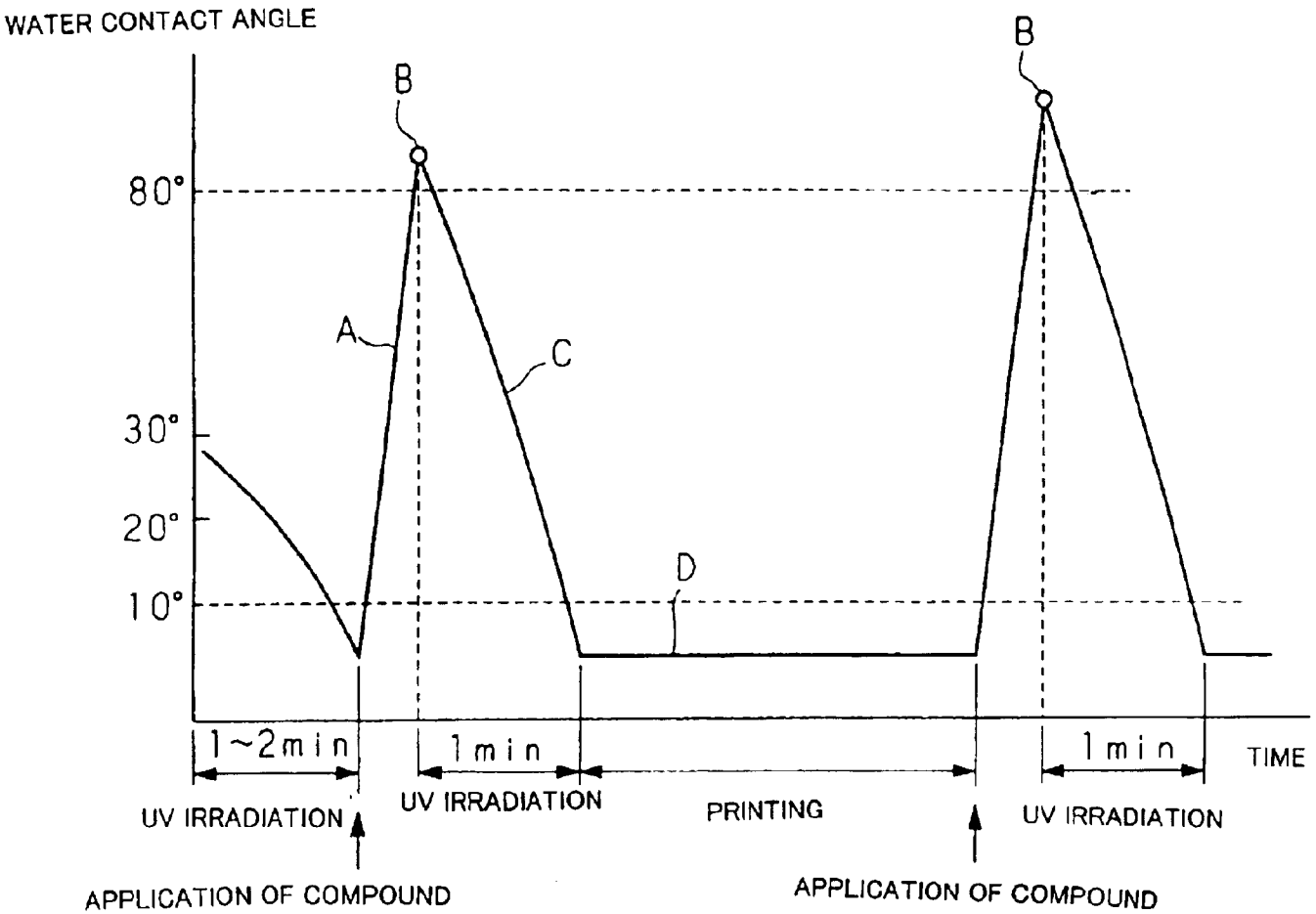
FIG. 10 is a graph illustrating the state of conversion from hydrophobicity to hydrophilicity of a surface of the coat layer with the passage of time.

FIG. 10 is a graph illustrating in summary what is explained above. This is a graph plotting time in the horizontal axis vs. water contact angle in the the vertical axis, illustrating succession in water contact angle (a hydrophobic state or a hydrophilic state) on the surface of the printing plate material of the present embodiment with the passage of time. FIG. 10 shows the results obtained with a titanium oxide photocatalyst having an ability of completing the conversion from hydrophobicity to hydrophilicity although the titanium oxide photocatalyst alone tends to be insufficient in performance relating to hydrophobicity (having a water contact angle of less than 50° before irradiation with ultraviolet rays).

In this case, as described above, the surface of the coat layer 23 in the original state has a water contact angle of 20 to 30°, thus exhibiting an insufficient hydrophobic property. Therefore, the surface of the coat layer 23, as it is, is insufficient for use as a printing image portion and cannot be used as a printing plate material. However, the titanium oxide photocatalyst has an ability of being quickly converted to form a hydrophilic surface upon irradiation with ultraviolet rays. Usually, this conversion takes generally about 10 minutes. In this example, however, it can be seen that the conversion is completed in 1 to 2 minutes.

Next, the compound is coated onto the surface of the coat layer 23. That is, formation of the coating layer 24 increases the hydrophobicity of the printing plate material to a sufficient state as indicated by point B via point A. That is, adhesion of an ink is made possible so that it can be in a state where it is supplied for use in printing. This is, the "initial state of the printing plate material as prepared" (point B in FIG. 10). To cause the "initial state of the printing plate material as prepared" to emerge, it is substantially sufficient to merely coat the compound as described above, so that obviously, such operation can be completed in a very short time.

Thereafter, irradiation with ultraviolet rays is performed to decompose the above compound and convert at least a portion of the surface of the coat layer 23 to a hydrophilic portion. In this case, the conversion from hydrophobicity to hydrophilicity in the titanium oxide photocatalyst can be completed in 1 to 2 minutes as indicated by curve C in FIG. 10 by three effects. The first one is the effect of using the above-described titanium oxide photocatalyst having a high rate of conversion from hydrophobicity to hydrophilicity, the second one is a speedy completion of the decomposition of the compound by the inherent catalytic effect of the titanium oxide photocatalyst as described above, and the third one is an increase in the rate of hydrophilization by the addition of at least one of $Fe^{2+}$, $Ni^{2+}$, $Mn^{2+}$, $Cr^{3+}$, and $Cu^{2+}$.

To the printing plate material subjected to the above treatment, a printing ink is adhered and actual printing is performed as indicated by the straight line D in FIG. 10. Subsequent to completion of the printing, the printing plate material is subjected to treatments such as coating of the compound and irradiation with ultraviolet rays similarly to the above before it can be recycled.

As described immediately above, the printing plate material of the present embodiment has an advantage that it can be recycled and in addition another advantage that its cycle can be speeded up. That is, according to the above advantages, no excessive time is necessary for realization of imparting either hydrophobicity or hydrophilicity. Therefore, the whole printing process can be completed very quickly.

Hereafter, a more specific example relating to preparation and printing of a printing plate material relating to the embodiment which the present inventors have confirmed will be described. First, a coat layer 23 is formed in a manner similar to that in the first embodiment. Further, on the surface of the coat layer 23 was coated by roll coating a hydrophobization treating solution prepared by diluting octadecyltrimethoxysilane (trade name: TSL8185) manufactured by Toshiba Silicone Co., Ltd. with ethanol to a concentration of 3% by weight while slowly stirring for 5 minutes and adding 5,000 ppm of formic acid to the resulting solution, followed by slowly stirring again for 5 minutes. This was dried at 100° C. to form a coating layer, and the "initial state of the printing plate material as prepared" as explained heretofore repeatedly was caused to emerge.

The printing plate material coated with the above hydrophobization treatment solution (i.e., an ethanol solution of octadecyltrimethoxysilane and formic acid) and dried was masked in its central part by black paper in the form of a square of 2 cm long in each side. The unmasked portion was irradiated with ultraviolet rays at an illuminance of 40 $mW/cm^2$ for "1 minute" and immediately thereafter, the water contact angles of the masked portion and ultraviolet irradiated portion were measured using a CA-W type contact angle meter manufactured by Kyowa Kaimen Kagaku Co., Ltd. to obtain water contact angles of the masked portion and ultraviolet irradiated portion of 82° and 0 to 2°, respectively. Thus the masked portion exhibits hydrophobicity sufficient for use as a printing image portion while the ultraviolet irradiated portion exhibits hydrophilicity sufficient for use as a non-printing image portion.

The printing plate material was set on a card printing machine of SAN OFF-SET 220E DX type manufactured by SAN PRINTING MACHINES CO. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFELLOW manufactured by Mitsubishi Heavy Industries, Ltd. at a printing speed of 2500 sheets/hour. As a result, no ink adhered to the ultraviolet irradiated portion of the surface of printing plate material while a red image in the form of a square having a length of 2 cm in each side was printed on the paper.

Subsequently, after printing was finished and the ink and the dampening water were wiped off thoroughly, the hydrophobization treatment solution was coated onto the printing plate material in the same manner as described above and dried. Further, the central portion of the surface of printing plate material was masked by a circular black paper having a diameter of 2 cm and the obtained printing plate material was irradiated with ultraviolet rays at an illuminance of 40 $mW/cm^2$ for 1 minute to form a sample. This treatment corresponds to the treatment to be practiced on recycling printing plate materials. In this case too, the ultraviolet irradiated portion had a water contact angle of 0 to 2°, showing sufficient hydrophilicity for use as a non-printing image portion and in actual printing, a red image could be printed on the paper in the form of a circle having a diameter of 2 cm corresponding to the masked portion of the printing plate material.

Next, in a state where the printing plate was set on a card printing machine, the ink and dampening water adhered to the surface of the printing plate were wiped off and the above-described hydrophobization treatment solution was coated onto the surface of printing plate by roll coating. Thereafter, it was dried in hot air at 120° C. to render hydrophobic the surface of the printing plate material. The hydrophobized printing plate material in its substantially central portion was masked by a black paper in the form of a regular triangle of 2 cm long in each side and the non-masked portion was irradiated with ultraviolet rays at an illuminance of 40 $mW/cm^2$ for 1 minute. Using this printing plate material, printing was performed in the same manner as in the printing as described above. As a result, no ink adhered to the ultraviolet irradiated portion of the surface of printing plate material while a red image in the form of a regular triangle having a length of 2 cm in each side could be printed on the paper.

The above printing was performed using the printing machine 10 as shown in FIG. 11 and described in the first embodiment. Specifically, the printing machine 10 comprises a coating apparatus 12, a blanket cylinder 13, a plate cleaning apparatus 14, a writing apparatus 15, an inking roller 16, and a drying apparatus 17 around the plate cylinder 11 in the center. The printing plate material is arranged wound around the plate cylinder 11.

In the printing machine 10, the actual process for recycling the printing plate material after the printing is performed as follows. First, the plate cleaning apparatus 14 was brought into contact with the plate cylinder 11 and the ink and dampening water adhered to the outermost surface of the printing plate, i.e., the printing area, were wiped off. Thereafter, the plate cleaning apparatus 14 was released from the plate cylinder 11 and the coating apparatus 12 was brought into contact with the plate cylinder 11. By so doing, the coat layer 3 was being renewed on the printing plate material. Thereafter, the coating apparatus 12 was released from the plate cylinder 11, followed by operating the drying apparatus 17 to evaporate the solvents, etc., contained in the coat layer 3. Then, an image was written on the renewed surface of the coat layer 3 with ultraviolet rays emitted by the writing apparatus 15 based on digital data of the image provided in advance. After completion of the above steps, the inking roller 16 and the blanket cylinder 13 were brought into contact with the plate cylinder 11. Then paper 18 was fed so as to make contact with the blanket cylinder 13 and to be carried in the direction of the arrow as shown in FIG. 11 so that continuous printing could be performed.

As described above, the printing plate material of the present embodiment makes the best of the property of titanium oxide photocatalyst, i.e., its property of converting hydrophobicity to hydrophilicity, thereby enabling its recycling and considerably decreasing the amount of printing plate material to be disposed of after use. Therefore the cost incurred by printing plate materials can be decreased to a greater extent accordingly. Since writing an image to the printing plate materials can be practiced from the digital data on the image directly by light (ultraviolet rays), adaptation to the digitization of printing process is achieved so that reduction in time and saving costs can be made to a greater extent accordingly.

As referred to above, in the case of the present embodiment where recycling of printing plate materials is achieved by formation of the coating layer 24 composed of the compound, speeding up of the whole printing process is made possible. It makes a great contribution to this that the decomposition of the compound is promoted by the inherent catalytic effect of the titanium oxide photocatalyst so that it can be completed quickly. Further, utilization of the titanium oxide photocatalyst which has a high rate of conversion from hydrophobicity to hydrophilicity and incorporation of at least one of $Fe^{2+}$, $Ni^{2+}$, $Mn^{2+}$, $Cr^{3+}$, and $Cu^{2+}$ in the form of ions, oxides, or composite oxides with titanium contribute to a further speeding up of the conversion.

In addition, the treatment contemplated for the achievement of the recycling of printing plate materials can be performed in the printing machine so that speeding up of the printing operation can be realized. In the above example, writing of images to the coating layer 24 has also been performed in a printing machine, and thereby more speedy operation can be realized.

In the present embodiment, the intermediate layer 22 was provided between the substrate 21 and the coat layer 23. However, the present invention is not limited thereto. That is, the intermediate layer 22 does not have to be provided. This is because the major essential features of the present invention are not harmed by the absence of the intermediate layer 22 as will be apparent from the explanation thus far made.

Third Embodiment

Hereafter, a third embodiment of the present invention will be described with reference to the attached drawings. In the third embodiment, the same constituent elements as those in the first embodiment have the same reference numerals and detailed explanation thereof is omitted here.

The layer construction of the printing plate material of the third embodiment is the same as that of the printing plate material of the first embodiment as shown in FIG. 1.

On the surface of the substrate 1 is formed an intermediate layer 2.

On the intermediate layer 2 is formed a coat layer 3 containing a titanium oxide photocatalyst. Unlike the first embodiment, in order to increase the sensitivity of the titanium oxide photocatalyst to light, the surface of the titanium oxide photocatalyst or the photocatalyst phase contains a group VIa or IVb metal or its oxide instead of $Fe^{2+}$, $Ni^{2+}$, $Mn^{2+}$, $Cr^{3+}$, and $Cu^{2+}$.

In the case where an image is directly written based on digital data, a proper plate material sensitivity is 0.005 to 2 $J/cm^2$ in order to manufacture a writing apparatus which is practical in view of cost, the size of the apparatus, and so on. However, it is not easy to achieve this plate material sensitivity with the titanium oxide photocatalyst alone. Accordingly, the present inventors investigated the possibility of adding a substance which has sensitizing effect, and found that a group VIB or IVA metal is effective in exertion of sensitizing effect.

The surface of the coat layer 3 is hydrophobic in an initial state of the printing plate as prepared, and a portion which is hydrophilic emerges by irradiating the portion with light having a wavelength having an energy higher than a band gap energy of the titanium oxide photocatalyst, e.g., ultraviolet rays. This property is attributable to the property of the titanium oxide photocatalyst.

The other components of the coat layer 3 are similar to the components of the first embodiment.

The group VIB and IVA metals or metal oxides may be contained in the surface of the titanium oxide photocatalyst or in the photocatalyst phase. However, it is preferable that they be contained in the surface of the titanium photocatalyst. For example, in the case where the group VIB or IVA metal is contained in the surface of the titanium oxide photocatalyst, the group VIB or IVA metal can be incorporated into the surface of the titanium oxide photocatalyst by impregnating the surface of the titanium oxide photocatalyst with a solution containing the group VIB or IVA metal, and thereafter heat-treating the titanium oxide photocatalyst.

An example of a solution containing a group VIB metal is an aqueous ammonia solution of tungstic acid, molybdic acid, or chronic acid. Examples of solutions containing group IVA metal are an aqueous solution of tin nitrate ($Sn(NO_3)_4$), an acetone solution of germanium acetate ($Ge(CH_3COO)_4$), and an aqueous ammonia solution of lead nitrate ($Pb(NO_3)_2$). However, the solution containing group VIB or IVA metal is not limited to these examples.

The amount of the group VIB or IVA metal or its metal oxide added is 0.5 to 50% by weight, preferably 1 to 30% by weight, with respect to the amount of the titanium oxide photocatalyst. If this amount is less than 1%, it is difficult to bring out the effect of the addition the group VIB or IVA metal or its metal oxide. If the amount exceeds 500, the photocatalytic action inherent to titanium oxide is weakened.

Although the reason why the integration of such a metal or metal oxide with the titanium oxide photocatalyst increases the photocatalytic activity of titanium oxide is unknown, it is assumed that the metal or metal oxide has a function of increasing the charge separation efficiency of the photocatalyst.

The printing plate material of the third embodiment exhibits the same effects as those of the printing plate material of the first embodiment.

The printing plate material of the third embodiment exhibits the same operation and effect as those of the printing plate material of the first embodiment except that the step of renewing the printing plate material differs as follows.

That is, first the coat layer 3 after completion of the printing is wiped to remove the ink, dampening water, paper dust, etc., from the surface of the coat layer 3. Thereafter, a compound having an organic hydrophobic group in its molecule is brought into a reaction or a strong interaction with at least a hydrophilic portion in the surface of the plate material to hydrophobize the hydrophilic portion. Thus, the surface of the printing material can be renewed as a surface in its initial state, which is entirely hydrophobic.

It is preferable that the compound used in the above hydrophobization treatment not only have a function of imparting hydrophobicity to a hydrophilic surface by reacting or strongly interacting with at least a hydrophilic portion of the surface of the plate material, but also be easily decomposable by the action of the titanium oxide photocatalyst under irradiation with ultraviolet rays.

In addition, since a group VIB or IVA metal or its oxide n is added to the titanium oxide photocatalyst in order to increase the sensitivity of the plate material, the function of the titanium oxide photocatalyst to decompose organic substances is lower than that in the case of a photocatalyst with 100% titanium oxide. Accordingly, a compound which can sufficiently hydrophobize the hydrophilic portion in the surface of the plate material with a small amount and which can be easily decomposed and removed by the action of the titanium oxide photocatalyst is particularly preferable.

In addition, since dampening water is supplied continuously with ink to the surface of the plate material during printing, the water resistance of the compound to dampening water must be sufficient to maintain the function of forming the printing image portion. As a compound which satisfies the above conditions, a fatty acid dextrin is preferable.

Specifically, a solution prepared by dissolving a fatty acid dextrin in an organic solvent such as toluene is applied to the surface of the plate material in a necessary amount, and thereafter the surface of the plate material is hydrophobized by heat treatment at 50 to 120° C. The fatty acid dextrin solution may be applied to the surface of the plate material by a method such as spray coating, blade coating, dip coating, and roll coating. By writing a non-image portion again with ultraviolet rays on the plate which has thus regained hydrophobicity, repeated use of the plate is made possible.

The concentration of the fatty acid dextrin in the solution with the organic solvent may be 0.05% by weight or higher in view of hydrophobization. In order to decompose the fatty acid dextrin within a short time by the action of the titanium oxide photocatalyst during the image writing after renewal of the plate by way of hydrophobization, the concentration of the fatty acid dextrin may be 5% by weight or lower, and preferably 1% by weight or lower. The hydrophobization treatment of the present invention is characterized in that sufficient hydrophobization can be carried out with such a small amount of fatty acid dextrin, and as a result the fatty acid dextrin can be easily decomposed and hydrophilization is realized within a short time during the image writing after the renewal.

Figure 12:
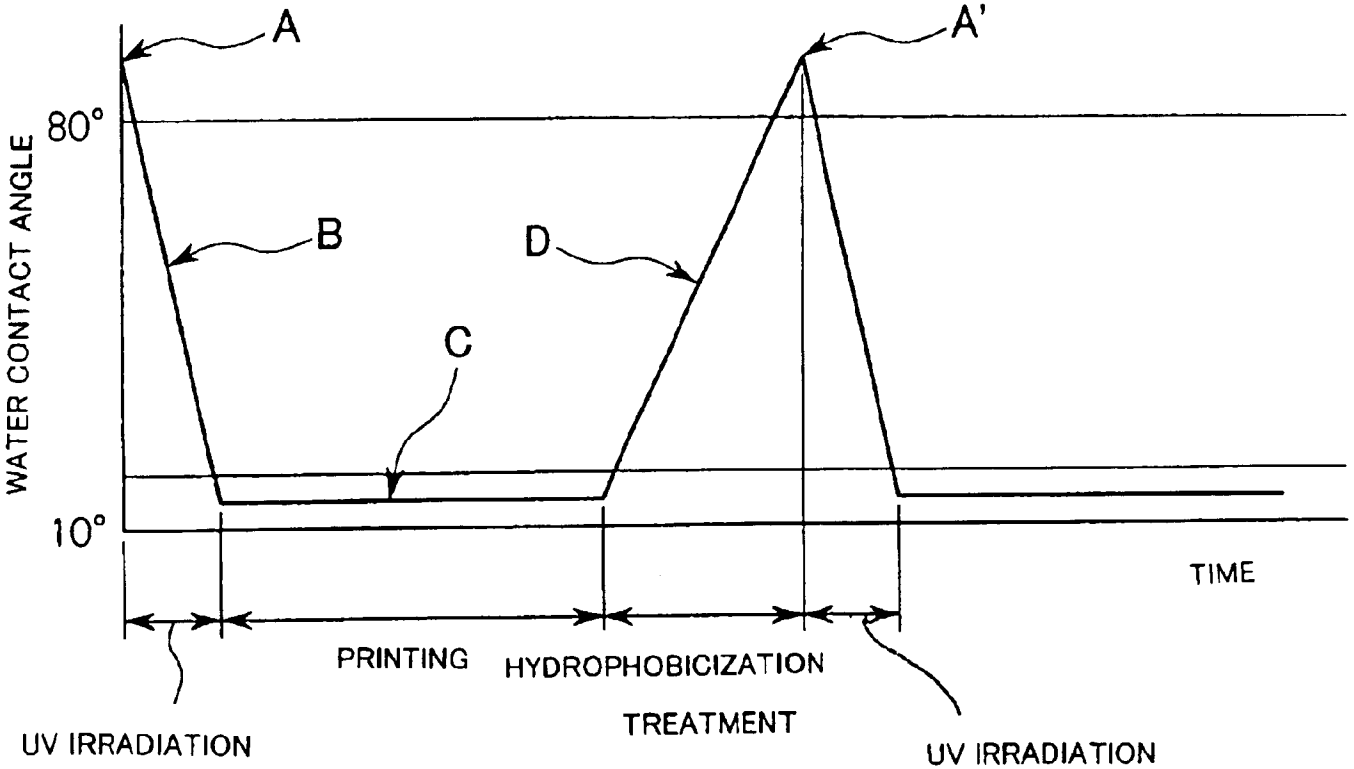
FIG. 12 is a graph illustrating the state of conversion from hydrophobicity to hydrophilicity of a surface of the coat layer with the passage of time.

FIG. 12 is a graph illustrating what has been explained above. This is a graph plotting time (or operation) in the horizontal axis vs. water contact angle in the the vertical axis, illustrating the change in water contact angle (i.e., a hydrophobic state or a hydrophilic state) concerning a certain point on the surface of the coat layer 3 with the passage of time.

According to this graph, first the surface of the original coat layer 3 has high hydrophobicity in terms of a water contact angle of 80° or more, which is the "initial state of the printing plate material as prepared" (point A in FIG. 12). Thereafter, irradiation with ultraviolet rays is performed to convert at least a portion of the surface of the coat layer 3 to a hydrophilic non-printing image portion with the ultraviolet non-irradiated portion remaining to be a hydrophobic printing image portion, thereby forming a printing plate material. Then, printing is performed as indicated by the straight line C in FIG. 12.

After completion of the printing, the adhering matter and dirt on the surface of the coat layer 3 were cleaned and the surface of the coat layer 3 was rendered hydrophobic again by the hydrophobization treatment with the above fatty acid dextrin solution (point A' in FIG. 12), that is, reverted to the "initial state of the printing plate material as prepared". Thus, the printing plate is recycled.

In the present invention, the step of uniformly rendering hydrophobic the entire surface of a plate material which is hydrophilic in at least a portion thereof and hydrophobic in the remainder so as to regain the "initial state as prepared" is referred to as renewal of a printing plate material.

As described above, the printing plate material of the present embodiment has an advantage that it can be recycled and in addition another advantage that its cycle can be speeded up. That is, by combining the titanium oxide photocatalyst having a high sensitivity to ultraviolet rays with the technique of hydrophobizing the surface of titanium oxide using a fatty acid dextrin, which can sufficiently hydrophobize the surface of the plate material by a treatment using a small amount the fatty acid dextrin, and which can be easily decomposed by the action of the titanium oxide photocatalyst, no excessive time is necessary for realization of imparting either hydrophobicity or hydrophilicity. Therefore, the whole printing process can be completed very quickly.

According to the present invention, a series of steps in the renewal process including cleaning of the plate surface after printing, renewal of the plate by hydrophobization treatment, and writing of non-printing image portion using ultraviolet rays can be carried out in a printing machine with the plate set on the printing machine.

In addition, by turning the light on and off in accordance with digital data, an image can be directly formed on the plate. If an image is written on a plate of A0 size (864 mm×1212 mm) having a plate material sensitivity of 0.005 to 2 J/cm$^2$, for example, the power of the irradiating light which is necessary for the image formation is 1.7 to 700 W.

Since a printing plate can be prepared by writing a non-printing image portion by irradiating the surface of the plate material in its initial state with light having the above power, the digitization of the printing process is possible. For the present invention, the process in which an image is written using light is hereinafter referred to as "preparation of printing plate".

The printing machine according to the present invention comprises at least a plate cylinder on which the plate material according to the present invention is mounted, a writing apparatus for forming an image directly on the plate material in accordance with digital data, a cleaning apparatus for removing ink from the surface of the plate material after printing, and a renewal apparatus for renewing the printing plate by hydrophobizing the plate material, and is characterized in that the steps of preparation and renewal of the plate are carried out in the printing machine. With this printing machine, a continuous printing operation can be performed without stopping the printing machine or intervening in an operation for exchanging printing plates.

It is needless to say that the plate cylinder in the printing machine according to the present invention may be a plate cylinder having a coat layer on the surface which is similar the surface of the plate material according to the present invention.

Figure 13:
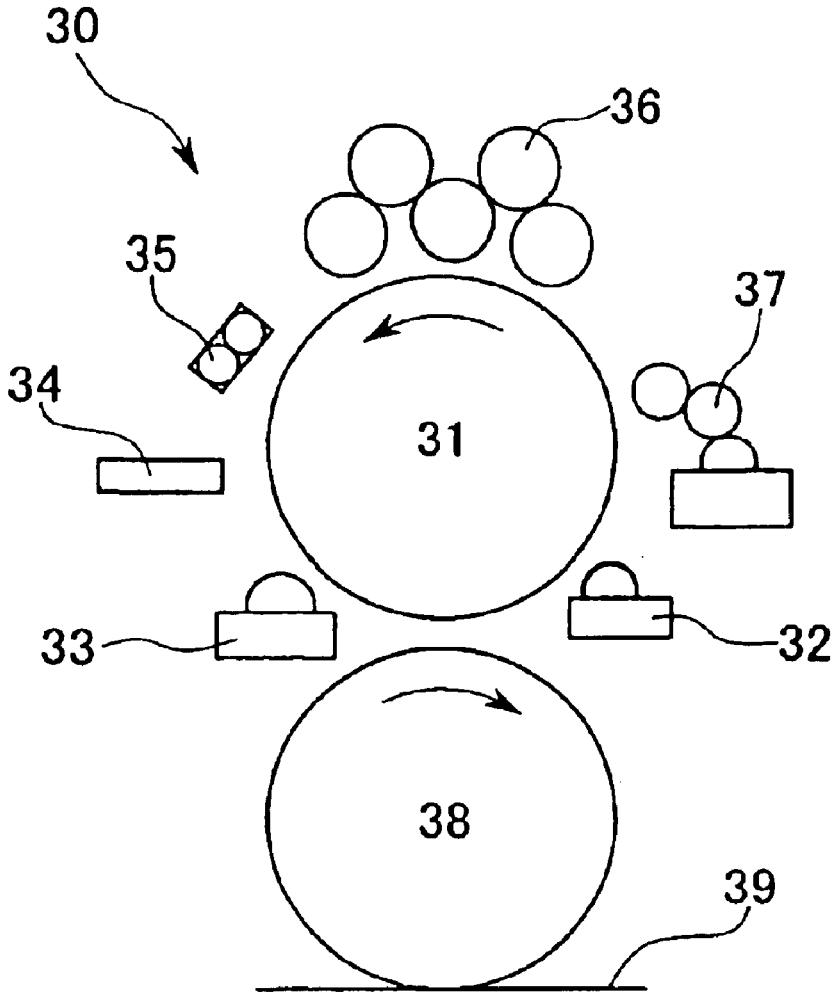
FIG. 13 is an illustrative diagram illustrating another example of the construction of a printing machine.

In addition, although it is preferable that the renewal apparatus for hydrophobizing the plate material be one in which a system of applying the fatty acid dextrin solution to the surface of the plate material is employed, the application method is not limited to the method exemplified in FIG. 13. After completion of hydrophobization treatment, the step of preparing the plate to be used in the next printing can be started.

Hereafter, a more specific example relating to preparation and printing of a printing plate material relating to the second embodiment which the present inventors have confirmed will be described. First, a substrate made of aluminum having a size of a post card and a thickness of 0.3 mm was provided. On this was coated a primer LAC PR-01 manufactured by Sakai Chemical Industry Co., Ltd. and dried. After the drying, the thickness of the primer layer was 0.8 $\mu$m. The primer layer corresponds to the intermediate layer 2 in FIG. 1. Thereafter, a titanium oxide photocatalyst coating agent LAC TI-01 manufactured by Sakai Chemical Industry Co., Ltd. was coated thereon and dried at 100° C. to form the coat layer having a thickness of 0.4 $\mu$m. Then, a solution of tungstic acid dissolved in aqueous ammonia (the concentration of tungstic acid: 0.5% by weight) was applied by roll coating, and thereafter a film of the coat layer 3 was formed by heat treatment at 400° C. for 40 minutes. After the formation of the film, the ratio of tungsten W to titanium Ti (W/Ti) was about 0.1.

The water contact angle of the coat layer 3 of this printing plate material was measured using CA-W type contact angle meter manufactured by Kyowa Kaimen Kagaku Co., Ltd., and a water contact angle of 88° was obtained, thus exhibiting hydrophobicity sufficient for use as a printing image portion. It was confirmed that the printing material was returned to its initial state as prepared.

Next, the central part of the printing plate material was masked by black paper in the form of a square of 2 cm long in each side. The unmasked portion was irradiated with ultraviolet rays at an illuminance of 12 mW/cm$^2$ for 20 seconds and immediately thereafter, the water contact angle of the ultraviolet irradiated portion was measured using a CA-W type contact angle meter to obtain a water contact angle of the ultraviolet irradiated portion of 8°. Thus the ultraviolet irradiated portion exhibits hydrophilicity sufficient for use as a non-printing image portion. The printing plate material was set on a desktop offset printing machine "NEW ACE PRO" manufactured by Alpha Techno Company. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFEL-LOW manufactured by Mitsubishi Heavy Industries, Ltd. at a printing speed of 3500 sheets/hour. As a result, no ink adhered to the ultraviolet irradiated portion of the surface of the printing plate material while a red image in the form of a square having a length of 2 cm in each side corresponding to the surface of masked portion was printed on the paper.

Subsequently, an example relating to the renewal of printing plate material will be explained. First, 0.2 g of fatty acid dextrin (manufactured by Chiba Seihun K.K.) was dissolved into 99.8 g of toluene (manufactured by Katayama Kagaku Kogyo K.K.) to prepare a treatment solution A (the concentration of fatty acid dextrin: 0.2% by weight). After printing, the treatment solution A was applied to the printing plate material from which the ink and dampening water adhered to the surface thereof were wiped off, and was dried off at 100° C. for 5 minutes. Immediately thereafter, the printing plate material was measured for a water contact angle at several points selected from over the whole surface using a CA-W type contact angle meter to obtain a water contact angle of 113°, thus exhibiting hydrophobicity sufficient for use as a printing image portion. It was confirmed that the printing plate material was in the initial state of the printing plate material as prepared.

Next, the central part of the printing plate material was masked by circular black paper having a diameter of 2 cm. The unmasked portion was irradiated with ultraviolet rays at an illuminance of 12 mW/cm$^2$ for 20 seconds and immediately thereafter, the water contact angle of the ultraviolet irradiated portion was measured using a CA-W type contact angle meter to obtain a water contact angle of the ultraviolet irradiated portion of 6°. Thus the masked portion exhibits hydrophilicity sufficient for use as a non-printing image portion. The printing plate material was set on a desktop offset printing machine "NEW ACE PRO" manufactured by Alpha Techno Company. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFELLOW manufactured by Mitsubishi Heavy Industries, Ltd. at a printing speed of 3500 sheets/hour. As a result, no ink adhered to the ultraviolet irradiated portion of the surface of the printing plate material while a circular red image having a diameter of 2 cm corresponding to the surface of masked portion was printed on the paper. This circular image was printed on each of 5000 sheets of paper. Even on the 5000th sheet, a circle as clear as ones initially printed was printed. Thus it was confirmed that the printing image portion formed by the hydrophobization treatment has sufficient water resistance (durability).

In order to perform the above-described printing and renewal of the plate in a printing machine, a printing machine 30 (printing apparatus) as shown in FIG. 13 is preferably used. Specifically, the printing machine 30 comprises a plate cleaning apparatus 32 (cleaning apparatus), a hydrophobization treatment apparatus 33 (renewal apparatus), a writing apparatus 34, a drying apparatus 35, an inking roller 36, a dampening water supplying apparatus 37, and a blanket cylinder 38 around a plate cylinder 31 in the center. The printing plate material is arranged wound around the plate cylinder 11.

In the printing machine 30, the renewal process of the printing plate material after completion of the printing is performed as follows. First, the plate cleaning apparatus 32 is brought into contact with the plate cylinder 31, and the ink and dampening water adhered to the outermost surface of the printing plate, i.e., the printing area, are wiped off. Thereafter, the plate cleaning apparatus 32 is released from the plate cylinder 31, the hydrophobization treatment apparatus 33 is brought into contact with the plate cylinder 31, and the fatty acid dextrin solution is applied to the plate cylinder 31. Then, the surface of the plate cylinder is heated and dried using the drying apparatus 35. By so doing, the printing plate material is subjected to the hydrophobization treatment as described above and is renewed to revert to the initial state of the printing plate material as prepared. Thereafter, the hydrophobization treatment apparatus 33 is released from the plate cylinder 31, and an image is written on the renewed surface of the coat layer 3 with ultraviolet rays emitted by the writing apparatus 34 based on the digital data on the image prepared in advance. After completion of the above steps, the inking roller 36, the dampening water supplying apparatus 37, and the blanket cylinder 38 are brought into contact with the plate cylinder. Continuous printing can be carried out by transporting the paper in the direction indicated by the arrow shown in FIG. 13 while contact between the paper 39 and the blanket cylinder 38 is maintained.

As described above, the printing plate material of the present embodiment allows speedy renewal thereof and a remarkable reduction in the amount of plate materials disposed of after their use by combining the technique of reducing the energy required for converting hydrophobicity to hydrophilicity by irradiating the titanium oxide photocatalyst with light with a wavelength having an energy higher than the band gap energy with the technique found by the present inventors in which a printing plate which has been used is renewed using a small amount of a compound which can hydrophobize the surface of the plate material. Therefore, the cost of printing plate materials and the cost for preparing the printing plate can be decreased to a greater extent accordingly. Since writing an image to printing plate materials can be practiced from the digital data on the image directly by light (ultraviolet rays), adaptation to the digitization of the printing process is achieved so that reduction in time and saving costs can be made to a greater extent accordingly.

Since reconversion of printing plate materials and renewal of the coat layer 3 can be performed in a printing machine, speeding up of the printing operation can be realized. In the above examples, writing of images to the surface of the coat layer 3 was performed in a printing machine and therefore operation can be practiced more speedily.

Fourth Embodiment

Hereafter, a fourth embodiment of the present invention will be described with reference to the drawings. In the fourth embodiment, the same constituent elements as those in the preceding embodiments are assigned the same reference numerals and detailed explanation thereof is omitted here.

The printing plate material of the fourth embodiment has the same layer construction and exhibits the same operation and effect as those of the printing plate materials of the first and third embodiments except that the step of renewing the printing plate material differs as follows.

That is, the surface of the plate material can be renewed to its initial state where the surface is entirely hydrophobic by first removing ink, dampening water, paper dust, etc., which adhered to the surface of the coat layer 3, after completion of the printing, and then allowing the compound having organic hydrophobic groups in its molecules to react or strongly interact with at least a hydrophilic portion in the surface of the plate material.

The above compound is preferably not only one having the effect of imparting hydrophobicity to the hydrophilic surface by reacting or strongly interacting with at least a hydrophilic portion on the surface of the plate material, but also one which can be easily decomposed by the action of the titanium oxide photocatalyst under irradiation with ultraviolet rays.

Figure 14:
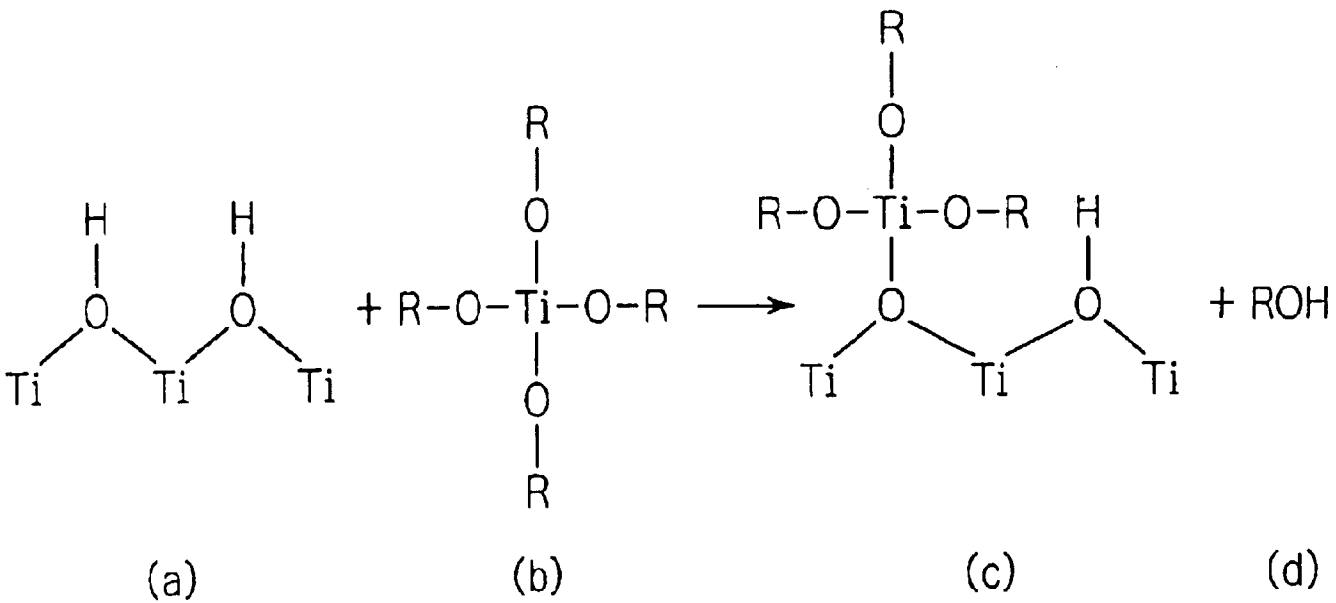
FIG. 14 is a reaction scheme illustrating the hydrophobization of the surface of titanium oxide using a compound.

Specifically, an organic titanium compound or an organic silane compound is preferable. Such a compound reacts with hydroxyl groups existing on the surface of the titanium oxide photocatalyst and is fixed there, so that a monomolecular-layer-like layer of hydrophobic groups should be formed on the surface of the titanium oxide in principle. The scheme of the reaction is shown in FIG. 14. The renewal process according to this embodiment is characterized in that hydrophobization of the surface of the titanium oxide, i.e., renewal of the plate material, can be performed by forming the above monomolecular-layer-like layer of hydrophobic groups.

According to the present invention, in the case where the renewal of the plate is followed by formation of a latent image on the plate by writing a non-printing image portion onto the surface of the plate using ultraviolet rays again, the monomolecular-layer-like layer of hydrophobic groups can be quickly decomposed and removed by the titanium oxide photocatalyst. Accordingly, this embodiment is effective in shortening the time required for writing an image on the plate material and reducing the energy of light. Moreover, since the monomolecular-layer-like layer of hydrophobic groups is chemically reacted with the surface of titanium oxide, the layer of hydrophobic groups has an extremely high durability in comparison with the case where a hydrophobic oil or fat or the like is applied. Furthermore, since the surface of titanium oxide is hydrophobized with the monomolecular-layer-like layer of hydrophobic groups, procedures for the renewal are simple, and the amount of materials required in the renewal is small. That is, there is an advantage that the cost for the renewal is low.

Examples of such organic titanium compounds and organic silane compounds are as follows.

(1) titanium alkoxides such as titanium tetraisopropoxide, titanium tetra-n-butoxide, and titanium tetrastearoxide;

(2) titanium acylates such as tri-n-butoxytitanium stearate and isopropoxytitanium tristearate;

(3) titanium chelates such as diisopropoxytitanium bisacetylacetonate and dihydroxy bislactatotitanium;

(4) alkoxysilanes such as trimethylmethoxysilane, trimethylethoxysilane, dimethyldiethoxysilane, methyltrimethoxysilane, tetramethoxysilane, methyltriethoxysilane, tetraethoxysilane, methyldimethoxysilane, octadecyltrimethoxysilane, and octadecyltriethoxysilane;

(5) chlorosilanes such as trimethylchlorosilane, dimethyldichlorosilane, methyltrichlorosilane, methyldichlorosilane, and dimethylchlorosilane;

(6) silane coupling agents such as vinyltrichlorosilane, vinyltriethoxysilane, γ-chloropropyltrimethoxysilane, γ-chloropropylmethyldichlorosilane, γ-chloropropylmethyldimethoxysilane, γ-chloropropylmethyldiethoxysilane, and γ-aminopropyltriethoxysilane; and (7) fluoroalkylsilane such as perfluoroalkyltrimethoxysilane.

However, the organic titanium compounds and the organic silane compounds are not limited to the above compounds. In addition, these compounds may of course be diluted with a solvent when used if necessary.

The organic titanium compound or the organic silane compound or a solution thereof may be applied to the surface of the plate material by a method such as spray coating, blade coating, dip coating, and roll coating, and thereafter may be dried at room temperature or with heating. By writing again a non-printing image using ultraviolet rays on the surface of the plate which has thus regained hydrophobicity, the plate can be repeatedly used.

FIG. 12 is a graph illustrating what has been explained above. This is a graph plotting time (or operation) in the horizontal axis vs. water contact angle in the the vertical axis, illustrating the change in water contact angle (i.e., a hydrophobic state or a hydrophilic state) concerning a certain point on the surface of the coat layer 3 with the passage of time.

According to this graph, first the surface of the original coat layer 3 has high hydrophobicity in terms of a water contact angle of 80° or more, which is the "initial state of the printing plate material as prepared" (point A in FIG. 12). Thereafter, irradiation with ultraviolet rays is performed to convert at least a portion of the surface of the coat layer 3 to a hydrophilic non-printing image portion with the ultraviolet non-irradiated portion remaining to be a hydrophobic printing image portion, thereby forming a printing plate material. Then, printing is performed as indicated by the straight line C in FIG. 12.

After completion of the printing, the adhering matter and dirt on the surface of the coat layer 3 were cleaned and the surface of the coat layer 3 was rendered hydrophobic again by the hydrophobization treatment with the above compound having an organic hydrophobic group in its molecule (point A' in FIG. 12), that is, reverted to the "initial state of the printing plate material as prepared". Thus, the printing plate is recycled.

As described above, the printing plate material of the present embodiment has an advantage that it can be recycled and in addition another advantage that its cycle can be speeded up. That is, by combining the titanium oxide photocatalyst having a high sensitivity to ultraviolet rays with the technique of hydrophobizing the surface of titanium oxide using a monomolecular layer of organic hydrophobic groups which can be easily decomposed by the action of the titanium oxide photocatalyst, no excessive time is necessary for realization of imparting either hydrophobicity or hydrophilicity. Therefore, the whole printing process can be completed very quickly.

According to the present invention, a series of steps in the renewal process including cleaning of the plate surface after printing, renewal of the plate by hydrophobization treatment, and writing of non-printing image portion using ultraviolet rays can be carried out in a printing machine with the plate set on the printing machine.

In addition, by turning the light on and off in accordance with digital data, an image can be directly formed on the plate. If an image is written on a plate of A0 size (864 mm×1212 mm) having a plate material sensitivity of 0.005 to 2 J/cm$^2$, for example, the power of the irradiating light which is necessary for the image formation is 1.7 to 700 W.

Since a printing plate can be prepared by writing a non-printing image portion by irradiating the surface of the plate material in its initial state with light having the above power, the digitization of the printing process is possible.

The printing apparatus used in this embodiment has a similar structure to that of the printing apparatus used in the third embodiment, and thus has similar functions and effects to those of the printing apparatus used in the third embodiment.

Hereafter, a more specific example relating to the printing plate material and the printing system which the present inventors have confirmed will be described. First, a substrate made of aluminum having a size of a post card and a thickness of 0.3 mm was provided. On this was coated a primer LAC PR-01 manufactured by Sakai Chemical Industry Co., Ltd. and dried. After the drying, the thickness of the primer layer was 0.8 μm. The primer layer corresponds to the intermediate layer 2 in FIG. 1. Thereafter, a titanium oxide photocatalyst coating agent LAC TI-01 manufactured by Sakai Chemical Industry Co., Ltd. was coated thereon and dried at 100° C. to form the coat layer having a thickness of 0.4 μm. Then, a solution of tungstic acid dissolved in aqueous ammonia (the concentration of tungstic acid: 0.5% by weight) was applied by roll coating, and thereafter a film of the coat layer 3 was formed by heat treatment at 400° C. for 40 minutes. After the formation of the film, the ratio of tungsten W to titanium Ti (W/Ti) was about 0.1.

The water contact angle of the coat layer 3 of this printing plate material was measured using CA-W type contact angle meter manufactured by Kyowa Kaimen Kagaku Co., Ltd., and a water contact angle of 94° was obtained, thus exhibiting hydrophobicity sufficient for use as a printing image portion. It was confirmed that the printing material was returned to its initial state as prepared.

Next, the central part of the printing plate material was masked by black paper in the form of a square of 2 cm long in each side. The unmasked portion was irradiated with ultraviolet rays at an illuminance of 40 mW/cm$^2$ for 20 seconds and immediately thereafter, the water contact angle of the ultraviolet irradiated portion was measured using a CA-W type contact angle meter to obtain a water contact angle of the ultraviolet irradiated portion of 7°. Thus the ultraviolet irradiated portion exhibits hydrophilicity sufficient for use as a non-printing image portion. The printing plate material was set on a desktop offset printing machine "NEW ACE PRO" manufactured by Alpha Techno Company. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFELLOW manufactured by Mitsubishi Heavy Industries, Ltd. at a printing speed of 3500 sheets/hour. As a result, no ink adhered to the ultraviolet irradiated portion of the surface of the printing plate material while a red image in the form of a square having a length of 2 cm in each side corresponding to the surface of masked portion was printed on the paper.

Subsequently, an example relating to the renewal of printing plate material will be explained. First, 2 g of titanium tetra-n-butoxide (manufactured by Nippon Soda Co., Ltd.) was dissolved into 98 g of "ISOPAR L" (manufactured by Exxon Chemical Company) to prepare a treatment solution B. After printing, the treatment solution B was applied to the printing plate material from which the ink and dampening water adhered to the surface thereof were wiped off, and was dried off at 60° C. for 5 minutes. Immediately thereafter, the printing plate material was measured for a water contact angle at several points selected from over the whole surface using a CA-W type contact angle meter to obtain a water contact angle of 102°, thus exhibiting hydrophobicity sufficient for use as a printing image portion. It was confirmed that the printing plate material was in the initial state of the printing plate material as prepared.

Next, the central part of the printing plate material was masked by circular black paper having a diameter of 2 cm. The unmasked portion was irradiated with ultraviolet rays at an illuminance of 40 mW/cm$^2$ for 20 seconds and immediately thereafter, the water contact angle of the ultraviolet irradiated portion was measured using a CA-W type contact angle meter to obtain a water contact angle of the ultraviolet irradiated portion of 5°. Thus the masked portion exhibits hydrophilicity sufficient for use as a non-printing image portion. The printing plate material was set on a desktop offset printing machine "NEW ACE PRO" manufactured by Alpha Techno Company. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFELLOW manufactured by Mitsubishi Heavy Industries, Ltd. at a printing speed of 3500 sheets/hour. As a result, no ink adhered to the ultraviolet irradiated portion of the surface of the printing plate material while a circular red image having a diameter of 2 cm corresponding to the surface of masked portion was printed on the paper. This circular image was printed on each of 5000 sheets of paper. Even on the 5000th sheet, a circle as clear as ones initially printed was printed. Thus it was confirmed that the printing image portion formed by the hydrophobization treatment has sufficient durability.

In order to perform the above-described printing and renewal of the plate in a printing machine, a printing system 30 as shown in FIG. 13 is preferably used.

As described above, the printing plate material of the present embodiment allows both recycling thereof and a remarkable reduction in the amount of plate materials disposed of after their use by utilization of the known properties of titanium oxide photocatalyst, i.e., the properties of converting hydrophobicity to hydrophilicity by irradiation with light with a wavelength having an energy higher than a band gap energy of the photocatalyst, in combination with the technique of converting hydrophilicity to hydrophobicity that the present inventors have found. Therefore, the cost of printing plate materials can be decreased to a greater extent accordingly. Since writing an image to printing plate materials can be practiced from the digital data on the image directly by light (ultraviolet rays), adaptation to the digitization of the printing process is achieved so that reduction in time and saving costs can be made to a greater extent accordingly.

Since reconversion of printing plate materials and renewal of the coat layer 3 can be performed in a printing machine, speeding up of the printing operation can be realized. In the above examples, writing of images to the surface of the coat layer 3 was performed in a printing machine and therefore operation can be practiced more speedily.

Fifth Embodiment

Hereafter, a fifth embodiment of the present invention will be described with reference to the drawings. In the fifth embodiment, the same constituent elements as those in the preceding embodiments are assigned the same reference numerals and detailed explanation thereof is omitted here.

The printing plate material of the fifth embodiment has the same layer construction and exhibits the same operation and effect as those of the printing plate material of the first embodiment except that the step of renewing the printing plate material differs as follows.

That is, in the step of renewing the printing plate material of the fifth embodiment, first the coat layer 3 after completion of the printing is wiped to remove the ink, dampening water, paper dust, etc., from the surface of the coat layer 3. Thereafter, the surface of the coat layer 3 is dipped in an aqueous electrolyte solution and voltage is applied to the substrate 1. In this case, simultaneously with the application of voltage, the surface of the coat layer 3 is irradiated with ultraviolet rays. Practice of such an electrochemical treatment renders the entire surface of the coat layer 3 hydrophobic and reversed to the "initial state of the printing plate material as prepared." On this surface, irradiation with ultraviolet rays again enables preparation of a new printing plate. In short, the printing plate material of the present embodiment allows for its recycling, in other words repeated use.

As described earlier, hydrophilic surface which is inherently metastable tends to slowly shift to a hydrophobic surface, which is in a stable state. However, it is presumed that the electrochemical treatment according to the present invention described above accelerates the reaction of converting $Ti^{3+}$ to $Ti^{4+}$ to thereby reduce the time required for hydrophobization considerably.

Figure 15:
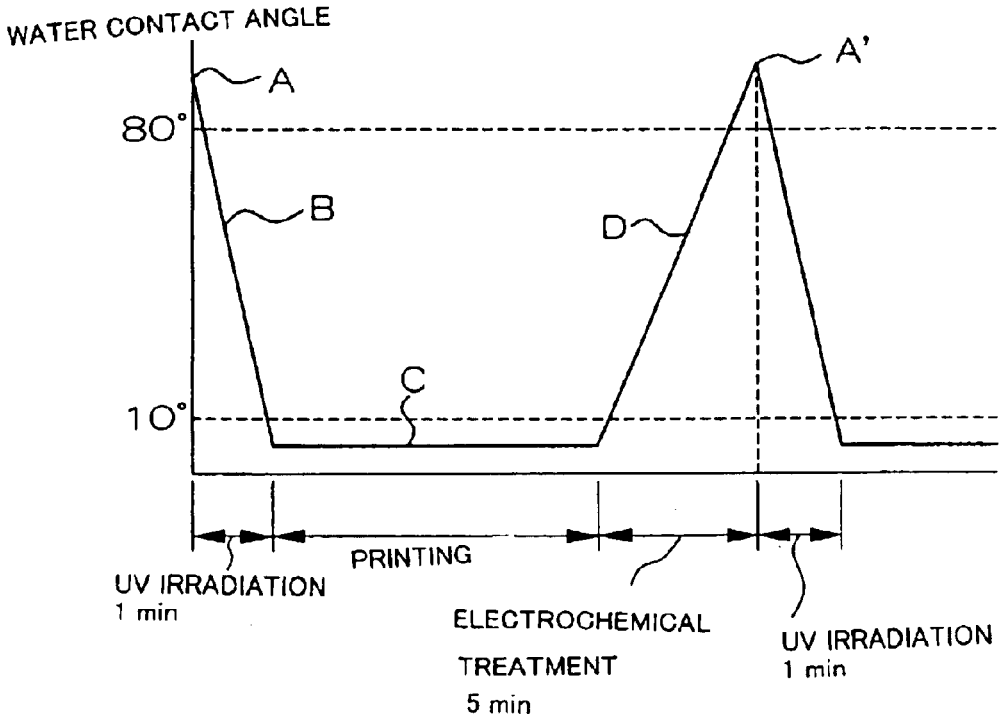
FIG. 15 is a graph illustrating the state of conversion from hydrophobicity to hydrophilicity and the sate of reconversion from hydrophilicity to hydrophobicity of a surface of the coat layer with the passage of time (or the progress of the operational procedure).

FIG. 15 is a graph illustrating what has been explained above. This is a graph plotting time (or operation) in the horizontal axis vs. water contact angle in the the vertical axis, illustrating the change in water contact angle (i.e., a hydrophobic state or a hydrophilic state) concerning a certain point on the surface of the coat layer 3 with the passage of time.

According to this graph, first the surface of the original coat layer 3 has high hydrophobicity in terms of a water contact angle of 80° or more, which is the "initial state of the printing plate material as prepared" (point A in FIG. 15). Thereafter, irradiation with ultraviolet rays is performed to convert at least a portion of the surface of the coat layer 3 to a hydrophilic non-printing image portion with the ultraviolet non-irradiated portion remaining to be a hydrophobic printing image portion, thereby forming a printing plate material. Then, printing is performed as indicated by the straight line C in FIG. 15. After completion of the printing, the adhering matter and dirt on the surface of the coat layer 3 were cleaned and the surface of the coat layer 3 was rendered hydrophobic again by the electrochemical treatment described above (point A' in FIG. 15), that is, reverted to the "initial state of the printing plate material as prepared". The printing plate is recycled.

As described immediately above, the printing plate material of the present embodiment has an advantage that it can be recycled and in addition another advantage that its cycle can be speeded up. That is, according to the above advantages, no excessive time is necessary for realization of imparting either hydrophobicity or hydrophilicity. Therefore, the whole printing process can be completed very quickly.

Hereafter, a more specific example relating to preparation and printing of a printing plate material relating to the second embodiment which the present inventors have confirmed will be described. First, a substrate made of aluminum having a size of a post card and a thickness of 0.3 mm was provided. On this was coated a primer LAC PR-01 manufactured by Sakai Chemical Industry Co., Ltd. and dried. After the drying, the thickness of the primer layer was 0.8 $\mu$m. The primer layer corresponds to the intermediate layer 2 in FIG. 1. Thereafter, a titanium oxide photocatalyst coating agent LAC TI-01 manufactured by Sakai Chemical Industry Co., Ltd. was coated thereon and dried at 100° C. to form the coat layer 3 having a thickness of 0.7 $\mu$m. The water contact angle of the coat layer 3 of this printing plate material was measured using CA-W type contact angle meter manufactured by Kyowa Kaimen Kagaku Co., Ltd., and a water contact angle of 84° was obtained, thus exhibiting hydrophobicity sufficient for use as a printing image portion. It was confirmed that the printing material was returned to its initial state as prepared.

Next, the central part of the printing plate material was masked by black paper in the form of a square of 2 cm long in each side. The unmasked portion was irradiated with ultraviolet rays at an illuminance of 40 mW/cm$^2$ for 1 minute and immediately thereafter, the water contact angle of the ultraviolet irradiated portion was measured using a CA-W type contact angle meter to obtain water contact angle of the ultraviolet irradiated portion of 6°. Thus the ultraviolet irradiated portion exhibits hydrophilicity sufficient for use as a non-printing image portion. The printing plate material was set on a card printing machine of SAN OFF-SET 220E DX type manufactured by SAN PRINTING MACHINES CO. Printing was performed on a coated board ("AIBESUTO PAPER"; trade name) with an ink HYECOO B Red MZ manufactured by Toyo Ink Manufacturing Co., Ltd. and dampening water, a 1% solution of LITHOFEL-LOW manufactured by Mitsubishi Heavy Industries, Ltd. at a printing speed of 2500 sheets/hour. As a result, no ink adhered to the ultraviolet irradiated portion of the surface of the printing plate material while a red image in the form of a square having a length of 2 cm in each side corresponding to the surface of masked portion was printed on the paper.

Subsequently, an example relating to the renewal of printing plate material will be explained. First, a printing plate material from which the ink and dampening water adhered to the surface thereof were wiped off was dipped in an aqueous $NaSO_4$ solution (concentration 0.1 M). A lead wire was connected to the substrate of the printing plate and the printing plate was irradiated with ultraviolet rays while a voltage of ±0.5 V was applied to the substrate. Immediately thereafter, the printing plate material was measured for a water contact angle at several points selected from over the whole surface using a CA-W type contact angle meter to obtain a water contact angle of 80 to 82°, thus exhibiting hydrophobicity sufficient for use as a printing image portion. It was confirmed that the printing plate material was in the initial state of the printing plate material as prepared.

Figure 16:
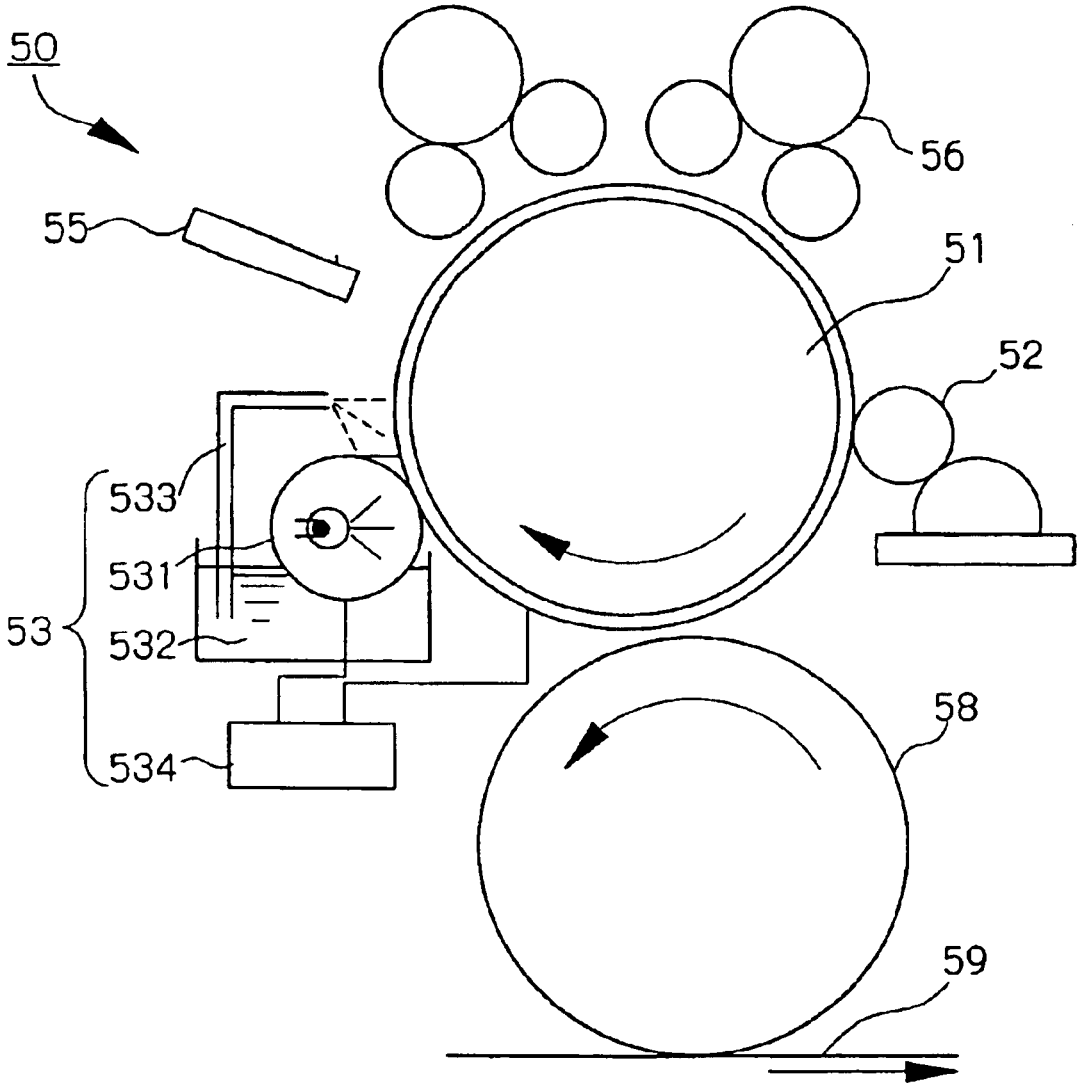
FIG. 16 is an illustrative diagram illustrating an example of the construction of a printing machine.

The printing was performed using a printing machine 50 as shown in FIG. 16. Specifically, the printing machine 50 comprises a plate cleaning apparatus 52 (cleaning apparatus), an electrochemical treating apparatus 53 (renewal apparatus), a writing apparatus 55, an inking roller 56, and a blanket cylinder 58 around a plate cylinder 51 in the center. The printing plate material is arranged wound around the plate cylinder 51.

In the printing machine 50, the renewal process of the printing plate material after completion of the printing is performed as follows. First, the plate cleaning apparatus 52 is brought into contact with the plate cylinder 51 and the ink and dampening water adhered to the outermost surface of the printing plate, i.e., the printing area, are wiped off. Thereafter, the plate cleaning apparatus 52 is released from the plate cylinder 51 and the electrochemical treating apparatus 53 is brought closer to the plate cylinder 51 so that a clearance between a transparent electrode 531 and the plate cylinder 51 is on the order of 100 to 200 $\mu$m. By so doing, the printing plate material is subjected to the hydrophobization treatment as described above and is renewed to revert to the initial state of the printing plate material as prepared. On this occasion, onto the surface of the printing plate material on the plate cylinder 51 is supplied an electrolyte solution (aqueous $NaSO_4$ solution in the above embodiment) 532 through an electrolyte solution supply nozzle 533. The transparent electrode 531 and the plate cylinder 51 are connected to power source 534.

Thereafter, the electrochemical treating apparatus 53 is released from the plate cylinder 51, and an image is written on the renewed surface of the coat layer 3 with ultraviolet rays emitted by the writing apparatus 55 based on the digital data on the image prepared in advance. After completion of the above steps, the inking roller 56, and the blanket cylinder 58, are brought into contact with the plate cylinder 51, and paper 59 is transported in the direction indicated by the arrow in FIG. 16 while maintaining contact with the blanket cylinder 58 to enable continuous printing.

As described above, the printing plate material of the present embodiment allows recycling thereof by utilization of the known properties of titanium oxide photocatalyst, i.e., the property of converting hydrophobicity to hydrophilicity by irradiation with light with a wavelength having an energy higher than a band gap energy of the photocatalyst and the property of converting hydrophilicity to hydrophobicity by an electrochemical treatment that the present inventors have found in combination, and decreases the amount of printing plate materials disposed of after their use. Therefore, the cost of printing plate materials can be decreased to a greater extent accordingly. Since writing an image to printing plate materials can be practiced from the digital data on the image directly by light (ultraviolet rays), adaptation to the digitization of the printing process is achieved so that reduction in time and saving costs can be made to a greater extent accordingly.

Since reconversion of printing plate materials and practice of renewal of the coat layer 3 can be performed in a printing machine, speeding up of the printing operation can be realized. In the above examples, writing of images to the surface of the coat layer 3 was performed in a printing machine and therefore operation can be practiced more speedily.

INDUSTRIAL APPLICABILITY

As described above, since a coat layer containing a titanium oxide photocatalyst is provided directly on the surface of a substrate of the printing plate material according to the present invention, or with an intermediate layer interposing, conversion of the surface of the plate material from hydrophobic to hydrophilic is possible by irradiating the surface with light (ultraviolet rays) having an energy higher than a band gap energy of the titanium oxide photocatalyst. Accordingly, utilization of the hydrophobic portion and the hydrophilic portion as a printing image portion and non-printing image portion, respectively, allows this printing plate material to function as an actual printing plate material. In addition, incorporation of a metal other than titanium allows the rate of hydrophilization under irradiation with ultraviolet rays to increase and allows the time for writing an image on the plate to be shortened. By providing an intermediate layer between the substrate and the coat layer in this case, sufficient adhesion between them is ensured.

What is claimed is:

1. A printing plate material comprising a substrate on the surface of which a coat layer comprising a titanium oxide photocatalyst and at least one of a group VIB metal which is W, or a group IVA metal selected from the group consisting of Ge and Pb, or an oxide of the group VIB or IVA metal, is formed directly or with an intermediate layer intervening between the substrate and the coat layer.

2. The printing plate material as claimed in claim 1, wherein the surface of said coat layer has hydrophobicity in terms of a water contact angle of at least 50° in its initial state.

3. The printing plate material as claimed in claim 1, wherein the surface of said coat layer is convertible to a hydrophilic surface having a water contact angle of 10° or less by irradiation with light having a wavelength at an energy level higher than a band gap energy level of the titanium oxide photocatalyst.

4. The printing plate material as claimed in claim 1, wherein the surface of said coat layer has hydrophobicity in terms of a water contact angle of at least 50° in its initial state and is convertible to a hydrophilic surface having a water contact angle of 10° or less by irradiation with light having a wavelength at an energy level higher than a band gap energy level of the titanium oxide photocatalyst.

5. The printing plate material as claimed in claim 4, wherein the hydrophilic surface serves as a non-printing image portion and the remaining hydrophobic surface serves as a printing image portion.

6. The printing plate material as claimed in claim 4, which requires an energy of 0.005 to 2 J/cm$^2$ for converting the hydrophobicity of the surface of the coat layer to hydrophilicity, and on which an image can be directly formed based on digital data.

7. The printing plate material as claimed in claim 1, wherein at least a portion of the surface of said coat layer is convertible to a hydrophilic surface, and the hydrophilic surface is reconvertible to a hydrophobic surface having a water contact angle of at least 50° by irradiation with a flux of energy thereon.

8. The printing plate material as claimed in claim 1, wherein at least a portion of the surface of the coat layer is convertible to a hydrophilic surface, and the hydrophilic surface is reconvertible to a hydrophobic surface having a water contact angle of at least 50° by a chemical conversion treatment thereon.

9. The printing plate material as claimed in claim 1, wherein at least a portion of the surface of the coat layer is convertible to a hydrophilic surface, and the hydrophilic surface is reconvertible to a hydrophobic surface having a water contact angle of at least 50° by irradiation with a flux of energy thereon and by a chemical conversion treatment thereon.

10. The printing plate material as claimed in claim 1, wherein said coat layer has a surface at least a part of which forms a part reconvertible to a hydrophilic surface by irradiation with light having a wavelength at an energy level higher than a band gap energy of the titanium oxide catalyst and a hydrophobic part which is not irradiated with the light, where the surface of the coat layer when subjected to light irradiation thereon and an electrochemical treatment thereon is hydrophobic.

11. The printing plate material as claimed in claim 10, wherein the surface of said coat layer has hydrophobicity in terms of a water contact angle of at least 50° in its initial state.

12. The printing plate material as claimed in claim 10, wherein the surface of said coat layer is convertible to a hydrophilic surface having a water contact angle of 10° or less by irradiation with light having a wavelength at an energy level higher than a band gap energy level of the titanium oxide photocatalyst.

13. The printing plate material as claimed in claim 10, wherein the surface of said coat layer has hydrophobicity in terms of a water contact angle of at least 50° in its initial state and is convertible to a hydrophilic surface having a water contact angle of 10° or less by irradiation with light having a wavelength at an energy level higher than a band gap energy level of the titanium oxide photocatalyst.

14. The printing plate material as claimed in claim 13, wherein the hydrophilic surface serves as a non-printing image portion and the remaining hydrophobic surface serves as a printing image portion.

15. The printing plate material as claimed in claim 10 wherein at least a portion of the surface of said coat layer is a hydrophilic surface, and the hydrophilic surface is reconvertible to a hydrophobic surface having a water contact angle of at least 50° by light irradiation thereon and an electrochemical treatment thereon.

16. A method for renewing a printing plate material as in the printing plate material of claim 10, the method comprising at least the steps of:

cleaning a surface of the coat layer containing the titanium oxide photocatalyst after completion of printing; and then renewing the coat layer containing a titanium oxide photocatalyst by light irradiation thereon and an electrochemical treatment thereon.

17. The printing plate material as claimed in claim 1, wherein at least a portion of the surface of said coat layer is a hydrophilic surface, and the hydrophilic surface is reconvertible to a hydrophobic surface having a water contact angle of at least 50° by cleaning the surface and renewing the surface of the coat layer containing the titanium oxide catalyst to renew the catalyst.

18. The printing plate material as claimed in claim 17, wherein the cleaning is polishing cleaning.

19. The printing plate material as claimed in claim 1, which further comprises on said coat layer a coating layer comprising a compound which can be decomposed by irradiation with light having a wavelength at an energy level higher than a band gap energy level of the titanium oxide photocatalyst.

20. The printing plate material as claimed in claim 19, wherein said at least one member selected from the group consisting of $Fe^{2+}$, $Ni^{2+}$, $Mn^{2+}$, $Cr^{3+}$, and $Cu^{2+}$ is contained as an oxide.

21. The printing plate material as claimed in claim 20, wherein the oxide is a compound oxide with titanium.

22. The printing plate material as claimed in claim 19, wherein the surface of said coating layer has hydrophobicity in terms of a water contact angle of at least 50° in its initial state.

23. The printing plate material as claimed in claim 19, wherein the surface of said coat layer is exposable and is convertible to a hydrophilic surface having a water contact angle of 10° or less by irradiation with the light.

24. The printing plate material as claimed in claim 19, wherein the surface of said coat layer has hydrophobicity in terms of a water contact angle of at least 50° in its initial state and is convertible to a hydrophilic surface having a water contact angle of 10° or less by irradiation with the light.

25. The printing plate material as claimed in claim 24, wherein the hydrophilic surface serves as a non-printing image portion and a hydrophobic surface of the coating layer serves as a printing image portion.

26. A method for renewing a printing plate material as in the printing plate material of claim 19, the method comprising at least the steps of:

cleaning an outermost surface of the printing plate material including a surface of the coat layer which surface is hydrophilic in at least a portion thereof after completion of printing; and then renewing the coating layer to cause a hydrophobic surface having a water contact angle of 50° or more to emerge.

27. The method for printing plate material as claimed in claim 26, wherein the step of cleaning the outermost surface and the step of renewing the coating layer are performed in a printing machine.

28. A method for preparing and renewing a printing plate material, the method comprising the steps, which are performed in a printing machine, of preparing a printing plate by irradiation of a surface of a coat layer of a printing plate material as claimed in claim 19 with light having a wavelength having an energy higher than a band gap energy of titanium oxide photocatalyst to cause the above described surface of the coat layer if the irradiated region to emerge, cleaning the outermost surface including the surface of the coat layer which has emerged, and renewing the coating layer.

29. The printing plate material as claimed in claim 1, wherein at least a portion of the surface of said coat layer is convertible to a hydrophilic surface, and the hydrophilic surface is reconvertible to a hydrophobic surface having a water contact angle of at least 50° with a compound having an organic hydrophobic group in its molecule.

30. The printing plate material as claimed in claim 29, wherein said compound having an organic hydrophobic group in its molecule is decomposable by a titanium oxide photocatalytic action under irradiation with light having an energy higher than a band gap energy of the titanium oxide photocatalyst.

31. The printing plate material as claimed in claim 29, wherein said compound having an organic hydrophobic group in its molecule is a fatty acid dextrin.

32. The printing plate material as claimed in claim 29, wherein said compound having an organic hydrophobic group in its molecule is an organic titanium compound.

33. The printing plate material as claimed in claim 29, wherein said compound having an organic hydrophobic group in its molecule is an organic silane compound.

34. The printing plate material as claimed in claim 1, which can be repeatedly used by repeating the steps of:

preparing a printing plate in which a latent image, which comprises a hydrophobic portion which is not irradiated with light and a portion which is irradiated with light to be changed to a hydrophilic surface, is formed by irradiating the printing plate material with light having an energy higher than a band gap energy of the titanium oxide photocatalyst, and renewing the printing plate material by bringing at least the hydrophilic portion on the surface of the plate material into contact with a compound having an organic hydrophobic group in its molecule after removing an ink from the surface of the printing plate material after completion of printing.

35. A method for renewing a printing plate material as claimed in claim 1, the method comprising the steps of:

cleaning a surface of the coat layer containing the titanium oxide photocatalyst after completion of printing; and then renewing the coat layer containing a titanium oxide photocatalyst.

36. The method for renewing a printing plate material as claimed in claim 35, wherein the step of cleaning the surface of the coat layer and the step of renewing the coat layer are performed in a printing machine.

37. A method for renewing a printing plate material as in the printing plate material of claim 1, the method comprising the steps of:

cleaning a surface of the coat layer containing the titanium oxide photocatalyst after completion of printing; and then renewing the coat layer containing a titanium oxide photocatalyst by irradiation with a flux of energy thereon.

38. A method for renewing a printing plate material as in the printing plate material of claim 1, the method comprising the steps of:

cleaning a surface of the coat layer containing the titanium oxide photocatalyst after completion of printing; and then renewing the coat layer containing a titanium oxide photocatalyst by a chemical conversion treatment thereon.

39. A method for renewing a printing plate material as in the printing plate material of claim 1, the method comprising the steps of:

cleaning a surface of the coat layer containing the titanium oxide photocatalyst after completion of printing; and then renewing the coat layer containing a titanium oxide photocatalyst by irradiation with a flux of energy thereon and a chemical conversion treatment thereon in combination.

40. A method for preparing and renewing a printing plate material, the method comprising the steps, which are performed in a printing machine, of preparing a printing plate by irradiation of a surface of a coat layer of a printing plate material as claimed in claim 1 with light having a wavelength having an energy higher than a band gap energy of the titanium oxide photocatalyst, cleaning the surface of the coat layer, and renewing the coat layer.

41. A printing plate material comprising a substrate on the surface of which a coat layer comprising a titanium oxide photocatalyst and $Cu^{2+}$ in the form of an ion or an oxide is formed directly or with an intermediate layer intervening between the substrate and the coat layer.

* * * * *